US010478002B2

(12) United States Patent
Pisani

(10) Patent No.: US 10,478,002 B2
(45) Date of Patent: Nov. 19, 2019

(54) SYSTEM FOR THE RITUAL AND GESTURAL LIGHTING OF ELECTRICAL OR ELECTRONIC LIGHT SOURCES

(71) Applicants: Patrizio Pisani, Rome (RM) (IT); Lucia Pisani, Terni (TR) (IT)

(72) Inventor: Patrizio Pisani, Rome (IT)

(73) Assignees: Patrizio Pisani, Rome (RM) (IT); Lucia Pisani, Rome (RM) (IT)

( * ) Notice: Subject to any disclaimer, the term of this patent is extended or adjusted under 35 U.S.C. 154(b) by 0 days.

(21) Appl. No.: 16/095,055

(22) PCT Filed: May 15, 2017

(86) PCT No.: PCT/EP2017/061591
§ 371 (c)(1),
(2) Date: Oct. 19, 2018

(87) PCT Pub. No.: WO2017/198604
PCT Pub. Date: Nov. 23, 2017

(65) Prior Publication Data

US 2019/0099030 A1 Apr. 4, 2019

(30) Foreign Application Priority Data

May 19, 2016 (IT) ..... 102016000051643

(51) Int. Cl.
*A47G 33/00* (2006.01)
*F21V 23/04* (2006.01)
(Continued)

(52) U.S. Cl.
CPC ..... *A47G 33/00* (2013.01); *F21S 6/001* (2013.01); *F21S 9/02* (2013.01); *F21V 23/003* (2013.01);
(Continued)

(58) Field of Classification Search
CPC ..... F21Y 2115/10; F21Y 2113/10; F21Y 2113/00; F21Y 2113/17; F21S 10/04;
(Continued)

(56) References Cited

U.S. PATENT DOCUMENTS 4,187,532 A 2/1980 Naffier
5,924,784 A * 7/1999 Chliwnyj ..... F21S 9/02 307/64
(Continued)

FOREIGN PATENT DOCUMENTS

WO 2012/098493 A1 7/2012
WO 2014/120818 A1 8/2014

OTHER PUBLICATIONS

International Search Report, dated Sep. 18, 2017, from corresponding PCT/EP2017/061591 application.

*Primary Examiner* — Vibol Tan
(74) *Attorney, Agent, or Firm* — Young & Thompson

(57) ABSTRACT

Method consisting in allowing a ritual gesture similar to that used to light a non-lit candle with a lit candle, the method using a system including at least two optical units for the ritual-gestural control of the sending/receiving commands between devices, the commands being turning on, turning off and the like, the devices being provided with at least the optical units.

21 Claims, 10 Drawing Sheets

(51) Int. Cl.

| | |
|---|---|
| ***F21V 23/00*** | (2015.01) |
| ***F21V 23/02*** | (2006.01) |
| ***H05B 33/08*** | (2006.01) |
| ***H05B 37/02*** | (2006.01) |
| ***F21S 6/00*** | (2006.01) |
| ***F21S 9/02*** | (2006.01) |
| *F21W 121/00* | (2006.01) |
| *F21Y 115/10* | (2016.01) |
| *F21W 131/40* | (2006.01) |

(52) U.S. Cl.
CPC ..... *F21V 23/02* (2013.01); *F21V 23/045* (2013.01); *F21V 23/0442* (2013.01); *F21V 23/0471* (2013.01); *F21V 23/0492* (2013.01); *H05B 33/0842* (2013.01); *H05B 33/0857* (2013.01); *H05B 37/0236* (2013.01); *H05B 37/0272* (2013.01); *F21W 2121/00* (2013.01); *F21W 2131/40* (2013.01); *F21Y 2115/10* (2016.08)

(58) Field of Classification Search
CPC .. F21S 6/001; F21S 9/02; F21S 10/046; F21S 10/043; F21S 6/00; F21S 8/035; F21S 10/005; H05B 37/0227; H05B 37/0272; H05B 33/0854; H05B 33/0872; H05B 33/0803; H05B 33/0857; H05B 33/0842; H05B 33/0845; H05B 33/0815; H05B 33/0824; H05B 37/02; H05B 33/0863; H05B 37/0245; H05B 37/0218; H05B 33/0809; H05B 37/0254; H05B 37/0236; Y10S 362/81; Y10S 362/806; Y10S 362/80; A61L 2209/12; H01K 7/06; G06F 3/017; G06F 1/1686; G06F 1/1694; G06F 3/011; G06F 3/04883; A47G 33/00; A47G 1/0616; F21V 23/0471; F21V 23/0492; F21V 23/003; F21V 23/02; F21V 23/045; F21V 23/0442; F21W 2131/40; F21W 2121/00
See application file for complete search history.

(56) References Cited

U.S. PATENT DOCUMENTS

| | | | | |
|---|---|---|---|---|
| 7,159,994 | B2 * | 1/2007 | Schnuckle | B44C 5/06 362/161 |
| 7,677,753 | B1 * | 3/2010 | Wills | F21S 6/00 362/161 |
| 7,824,627 | B2 * | 11/2010 | Michaels | A01M 1/205 239/102.2 |
| 8,070,319 | B2 * | 12/2011 | Schnuckle | F21S 10/04 362/249.02 |
| 8,132,936 | B2 * | 3/2012 | Patton | F21S 10/04 362/249.02 |
| 8,210,708 | B2 * | 7/2012 | Hau | H02J 50/10 362/183 |
| 8,256,935 | B1 * | 9/2012 | Cullimore | F21S 6/001 362/276 |
| 8,789,986 | B2 * | 7/2014 | Li | F21S 6/001 362/393 |
| 9,572,236 | B2 * | 2/2017 | Patton | F21V 33/0052 |
| 9,739,432 | B2 * | 8/2017 | Li | F21S 6/001 |
| 9,810,388 | B1 * | 11/2017 | Li | F21S 6/001 |
| 10,060,585 | B2 * | 8/2018 | Li | F21S 10/046 |
| 10,111,307 | B2 * | 10/2018 | Li | H05B 37/0272 |
| 2008/0117633 | A1 * | 5/2008 | Li | F21S 6/001 362/253 |
| 2011/0057583 | A1 | 3/2011 | Fattozzo | |
| 2019/0121147 | A1 * | 4/2019 | Pisani | G02B 19/0061 |

* cited by examiner

SYSTEM FOR THE RITUAL AND GESTURAL LIGHTING OF ELECTRICAL OR ELECTRONIC LIGHT SOURCES

FIELD OF THE INVENTION

The present invention relates to the computer and the electronic fields, and in particular to that of electronic lights, lighting control systems, interconnected object digital network systems.

In detail, the present invention relates to an electronically controlled light turning on system that is simple, intuitive and that maintains the gestures and rituals of the traditional lighting of candles.

The present invention also relates to a method of creating groups of lamps or objects interconnected by digital communication networks, based on the gestural turning on system. The present invention also relates to a method of creating local networks of interconnected objects that, by using the gestural turning on system, allows adding and configuring new objects to the local network in a simple, safe and intuitive manner.

PRIOR ART

Since human prehistory, light and fire have represented a fundamental symbol also in the emergence of religious thinking.

The "Homo Religiosus" was born looking at the light of the sun and the stars. The earliest certain traces date back to 9500 BC.

In ancient Indo-European language, the word "deiwo" (roots of +) means "shine", "giving light".

Anthropological research has shown that sacred symbolism plays a key role in the necessary mediation between "human and supernatural".

In this context, light immediately took the role of sacred symbol of the supernatural.

In all major religions, light plays a fundamental role in symbolism and ritual.

In sacred Christian texts, it is a symbol of God's presence, at Pentecost it is the symbol of the Holy Spirit, the Paschal candle is the light of Christ that lights the Church (and these are only some of the examples regarding Christianity).

In Buddhism, Buddha is represented with two types of light: the light that radiates from his body, which represents the intimately divine spirit, and the light that radiates from a flame on the head, which is the transmission of the divine to humanity.

In Islam, the Surat 24 at passage 35 is dedicated to light as a symbol of God, and is often associated with the Koran itself.

In Hinduism in the Upanishads, Brahma and Atman are identified with light. Light is present in many texts and disciplines dedicated to meditation.

This symbolism of light is anthropologically encoded in the human being and is associated with ancestral rituals.

Lighting a candle with another candle, the gestures of the action and its result represent the transmission of the divine and love.

In Christian baptism, the godfather lights a candle with the Paschal candle ritualizing the light of Christ that is transmitted to the baptized. In the rite of fire of Easter midnight mass, the believers carry candles in the church that are lit from the same fire outside the church, ritualizing the light of the risen Christ evoked three times by the priest.

It is clear that all these ancestral ritual meanings are fundamental in the value that each person gives to the lighting of a candle.

There are today many electronic candles, often similar in appearance to real candles. But what all these candles lack, although there have been commercial attempts, are the ritual gestures of lighting (one candle lighting another) and light transmission, which makes them "B-candles" compared to traditional candles.

As for the technology of the "networks of objects" (better known as the "Internet Of Things"), there are many standards and technologies to create networks of interconnected objects (including lights).

The "weakness", if one may say so, of these technologies is the "complexity" and lack of "intuitiveness" of the interconnection process of new objects to the local network, which often requires multiple pressures of keys, use of SW applications, input of sometimes complex parameters.

This lack of simplicity is one of the oppositions to the adoption of these technologies by most people.

Sometimes, the "complexity" is related to the fact that a high level of security is desired, wanting to prevent "unauthorized" objects from associating to the local network.

Another aspect that represents a complexity-related impediment to the adoption of these new technologies is the complexity of procedures required to connect to remote object services. Sometimes, the fact of having to use an APP to configure these services discourages the adoption of the service.

One aspect that is not always evident and strictly related to the first part of this paragraph is that if the "objects" we are talking about are related to ritual processes (the lighting of a candle during baptism), the technological complexity frustrates the ancestral-symbolic component of the gesture.

As regards data transmission via visible or invisible light, there are many technologies (think from the simplest ones used in remote controls to the most sophisticated ones used for data transmission over optical fiber, or data transmission via visible light, the so-called LiFi). Optical science and the properties of reflection, refraction and dispersion of optical radiation are of course prior art.

The object of the present invention is to give also to electronic objects (such as, by way of non-limiting example, votive lights or candles) the intuitive and ancestral gestures of candle lighting, thereby keeping the ritual meaning of the gestures made and making the creation process of complex "Internet of Things" services easy and intuitive, freeing such a process of the technical complexity that makes it inappropriate to everyday life, especially in the field of religious rituals. Not only that, this invention also allows improving and amplifying the evocative ritual aspects of religious practice that can be obtained with traditional flame candles.

In none of the known applications is there a gestural process such as the lighting of a candle, further associated with a method that by including the state of the object (whether it is the non-lit one that is lit, the one lit that lights up, or the lit one that is put off), allows differentiating commands and features allowing the creation of complex systems and functionalities.

The present invention for example allows a simple and intuitive creation of a set of lights forming a group: they just need to be lit with one another (as one would with real candles) starting from any of them that is lit belonging to the group to be created.

With the present invention, in order to associate a candle or an electronic light to a local network it is sufficient to light it (as one would with a real candle) with the light on the gateway.

With the present invention, if one wants a unit with a votive candle to be connected to the digital services displayed by a sanctuary, it is sufficient to light it with a similar electronic candle placed into the sanctuary, or even with a similar electronic candle lit in the sanctuary (keeping the ancestral meaning of light transmission as transmission of divine and supernatural).

The present invention allows improving and expanding the religious rituals: the candle that the godfather lights in the Paschal candle and that is donated to the child will always stay connected to the services of the Church where he was baptized.

The present invention also makes the process of associating an object to a network of objects easy and secure because only a person physically present near the gateway can perform on purpose the action of lighting the candle, and since the digital command transmitted between the two objects via the optical proximity link cannot be intercepted if one is not physically very close to the objects themselves.

SUMMARY OF THE INVENTION

According to the present invention, an electronic, optical, mechanical unit is provided which, by means of the associated methodology, allows the implementation of an intuitive gestural-ritual system of exchanging commands between devices provided with said unit, said unit comprising:

at least one upper part intended to convey and limit the optical radiation used to implement the digital communication channel, said upper part comprising at least one of the following parts: a cover with a hole, an outer structure of a material adapted to contain and limit the optical radiation (by way of non-limiting example metal, wood, plastic, frosted glass, wax), an optical guide (by way of non-limiting example plastic or glass).

At least one lower part containing the electrical and electronic circuitry needed, said circuitry comprising at least one photo-emitter device (by way of non-limiting example in the near-infrared band), at least one photo-detector device sensitive to the photo-emitter bandwidth, at least one electronic acquisition and control unit that modulates the digital encoding to be transmitted by piloting the photo-emitter, which acquires said digital encoding by reading and processing the output of the photo-detector, which manages the I/O required to be set and to set the connected components to one of the states belonging to the methodology described hereinafter.

Advantageously with the unit described above, a system with at least two units may be implemented, which implements a gestural-ritual method to open a digital electronic communication channel between the two units.

According to the present invention, the method is described which, by implementing the gestures of lighting a non-lit candle with a lit candle allows creating a communication channel between the two units.

Advantageously, the upper part of the unit is intended to contain and limit the optical radiation emitted by the photo-emitter of a first unit, which is received by the photo-detector of the second unit. The electro-optical driving and receiving circuitry advantageously further limits the optical power of the transmitter and the receiver sensitivity.

Thanks to these restrictions, the two units will establish the communication channel if and only if approached like a first candle lit which must light a second non-lit candle.

The method comprises an ACTIVE state on the first unit (which corresponds to the lit candle), and a STANDBY state of the second unit, which corresponds to the non-lit candle. A unit when in the ACTIVE state is the master of digital transaction and periodically sends a digital sequence that contains commands and data. Between one sending and the other, the ACTIVE master starts awaiting a response from a slave. A unit in ACTIVE state has active actuating circuitry (by way of non-limiting example, if it controls a visible light source, that light will be lit).

The slave unit in STANDBY state, if the optical path is defined and it receives the command emitted by the master, will respond to the ACTIVE master unit with a command (by way of non-limiting example, an acceptance code). A unit STANDBY state has deactivated actuating circuitry (by way of non-limiting example, if it controls a visible light source, that light will be non-lit).

A particular state similar to STANDBY is the BLOW state. A unit in a BLOW state is a unit that not necessarily has an actuating circuitry, which cannot be set to the ACTIVE state but which responds to an ACTIVE unit with which it interacts by sending a blow command to set it to the STANDBY state.

If for the sake of simplicity one thinks of real candles, the unit in BLOW state is equivalent to the blow that blows out a burning candle.

Advantageously, if the upper part of the unit contains the cover with a hole, an optical filter can be placed in this hole to reduce the optical power not belonging to the spectrum of the photo-emitter, preventing a visible light from blinding the receiver.

Advantageously, if the upper part contains the outer part, such part may consist of one or more materials (by way of non-limiting example metal, wood, plastic, frosted glass, wax) also overlapped (such as wax on wood).

Advantageously, if the upper part contains the optical guide, such an optical guide can have different coupling zones at the base thereof. Advantageously, a zone at the photo-emitter placed in the lower part can be processed to have the minimum dispersion within the guide, thereby reducing the optical power dispersed in the upper lateral zone.

Advantageously, said optical guide may have an area intended to modulate the dispersion of the optical coupling of a visible light source (by way of non-limiting example, a LED source) to create different illumination effects of the upper part.

Advantageously, said optical guide can have a third surface portion which has the property of being reflective to visible light and to the optical radiation of the photo-emitter. Such a surface will limit the visible optical power dispersed in the base (thereby increasing the optical performance of the light source) and will create multiple paths of reflection for the optical radiation of the digital channel that will reduce the optical power that will be conveyed to the photo-detector (since only the rays directly incident on the base section with maximum optical coupling will be transmitted to the lower part of the unit without further dispersions).

Advantageously, if the unit comprises a LED light source, this source can be modulated in intensity and color by the actuating circuit.

Advantageously, the unit may further limit the angle at which two units can be mechanically coupled by using an inclinometer controlled by the electronic control circuitry, thus limiting the relative angular range that the two units must have to generate an actuation command.

Advantageously, the unit may have an internal battery power source, which can be charged by the unit circuitry through an external adapter (AC-DC or DC-DC).

Advantageously, the unit may also comprise an electronic section that controls an audio input and an audio output.

Advantageously, the control unit may also contain electronic circuitry for a wireless connection of the unit (by way of non-limiting example, WiFi).

Advantageously, the unit may have at least one expansion connector that allows the wired connection thereof to other units or to the digital network.

Advantageously, the unit described above may be connected via the connector described above to an expansion unit having the corresponding counterpart connector. Such an expansion unit may house part of the electric-electronic components contained by the lower part of the unit described above.

Advantageously, said expansion unit may contain the components for charging the batteries of the unit, or the components for wireless connectivity. In this way, it is advantageously possible to create a system with a removable unit (with limited features but easily transportable), which takes all complete functions when connected to the expansion base.

Such an expansion base may be provided with more than one connector for the units described above and be used for the management of multiple units. In this configuration, it is for example possible to create votive electronic candle holders provided with the ritual lighting gestures. In this embodiment, a two-floored system may advantageously be provided which keeps the electronic candles made with the gestural ritual unit in STANDBY state (and charging the batteries) in the lower part. These electronic candles may be taken from the lower part, lit with an active candle of the upper part and placed in the upper part.

The system described above may advantageously be completed with a method that advantageously allows creating groups of objects also in mutually remote locations which exchange digital services, said groups being connected to such services via a local or remote, single or distributed server. These services may, by way of non-limiting example, be based on publish subscribe protocols (preferably but non-limitingly, MQTT), or be audio streaming services, or services provided via API.

This further method according to the present invention is always based on the above gestural-ritual methods but adds a high-level methodology that divides the units into three possible states: MOTHER, CHILD and CHILD GROUP. A unit may be set to one of the above states either using a special code in its memory or via an electro-mechanical switch. Advantageously, a unit according to this second method has an ID code that identifies it in the distributed system, controlled by the remote server.

The states of this second method combined with the ACTIVE and STANDBY states the previous method can be used for the simple and intuitive creation of complex systems, always based on the functional rituals of light transmission.

A unit in a MOTHER state according to this second methodology has the ability to transmit to a CHILD unit that is turned on by it (MOTHER ACTIVE, CHILD STANDBY) the properties and permissions (e.g. addresses of MQTT brokers, MQTT topics, user with password to subscribe to the topic) to allow such a second CHILD unit to subscribe to the digital services related to the MOTHER, published via the internet. The CHILD unit imports the properties of the MOTHER unit and sends them to all other the other CHILD units that it will turn on via the ACTIVE-STANDBY protocol. A unit in a CHILD GROUP state allows the creation of functional groups of units (such as a prayer group among multiple users using the units for bi-directional audio connection), creating a group with all CHILD units that it turns on when in the CHILD GROUP state. The groups thus created, unlike the properties of the MOTHER unit, are not transmitted among CHILD units. With this additional state it is possible to create temporary and limited groups.

Finally, by using the units described above and the gestural-ritual lighting method described above, it is advantageously possible to define another method to create digital unit networks in an intuitive and secure manner.

Advantageously, said method provides for a system with at least two units that can be set, through a stored code or an electromechanical switch, to one of the following states: GATEWAY, NODE, MATCHSTICK, SNUFFER. The system must include at least one unit in the GATEWAY state, which corresponds to a unit, in one of the above embodiments, which has the components to be connected on the one side to another digital network (e.g. the internet) and the other to manage local connectivity (e.g. WiFi). The GATEWAY unit exports to the other units that are turned on by it the properties for the connection to the local network (e.g. local IP address and PW). A NODE unit in STANDBY not belonging to the local network, if activated by the GATEWAY unit, is added to the local network. Other NODE units already added to the local network can add new NODE units to the network by simply turning them on. When a NODE unit already belonging to the network turns on another NODE unit also already belonging to the network, it form a functional group with it which can be controlled with a single command, imparted through an external device (such as a PC or a tablet connected to the GATEWAY).

Advantageously, a unit in the MATCHSTICK state behaves like a match which, lit by a candle, lights other candles. In fact, a MATCHSTICK unit lit by a GATEWAY imports the properties to add NODE units to the network (until it is turned off). In the same way, a MATCHSTICK unit can be used to create functional groups. Unlike a NODE unit, a MATCHSTICK unit does not functionally belong to the local network but is temporarily enabled to perform its function of match until it remains turned on.

A unit can advantageously take the SNUFFER state, in that state (when combined with the BLOW state of the gestural-ritual method) being able not only to turn off a NODE or GATEWAY unit, but also to send a command to clear all the properties of the unit that it has turned off (for example removing it from the local network or deleting the functional groups). In essence, a SNUFFER unit behaves like a BLOW with the further property to send a reset command to the unit it turns off.

DESCRIPTION OF THE FIGURES

The invention will be described hereinafter in a preferred embodiment thereof by way of non-limiting example with reference to the accompanying figures, in which:

FIG. 10 shows the function of the unit in GATEWAY state 3001 (step 0 of the illustration of method 3000);

FIG. 11 shows the addition of a NODE unit 3002 to the network of objects (3006) (step 1 of the illustration of method 3000);

FIG. 12 shows the addition of a second NODE unit (3002) to the network of objects (3006) (step 2 of the illustration of method 3000);

FIG. 13 shows the addition of a third NODE unit (3002) to the network of objects (3006) (step 3 of the illustration of method 3000);

FIG. 14 shows the first step in creating a functional group (3008) between units in NODE state (3002), through the use of a unit in MACHSTICK state (3003) (step 4 of the illustration of method 3000);

FIG. 15 shows the second step in creating a functional group (3008) between units in NODE state (3002), through the use of a unit in MACHSTICK state (3003) (step 5 of the illustration of method 3000);

FIG. 16 shows the addition of a NODE unit (3002) to the network of objects (3006), through the use of a unit in MACHSTICK state (3003) (step 6 of the illustration of method 3000);

FIG. 17 shows the first step in creating a functional group (3008) of NODE units (3002), through the use of a unit in MACHSTICK state (3003) (step 7 of the illustration of method 3000);

FIG. 18 shows the second step in creating a functional group (3008) of NODE units (3002), through the use of a unit in MACHSTICK state (3003) (step 8 of the illustration of method 3000);

FIG. 19 shows the disconnection of a NODE unit (3002) from the network of objects (3006) and from the functional groups (3008), through the use of a unit in BLOW state (3004) (step 9 of the illustration of method 3000);

DETAILED DESCRIPTION OF THE INVENTION

Figure 1:
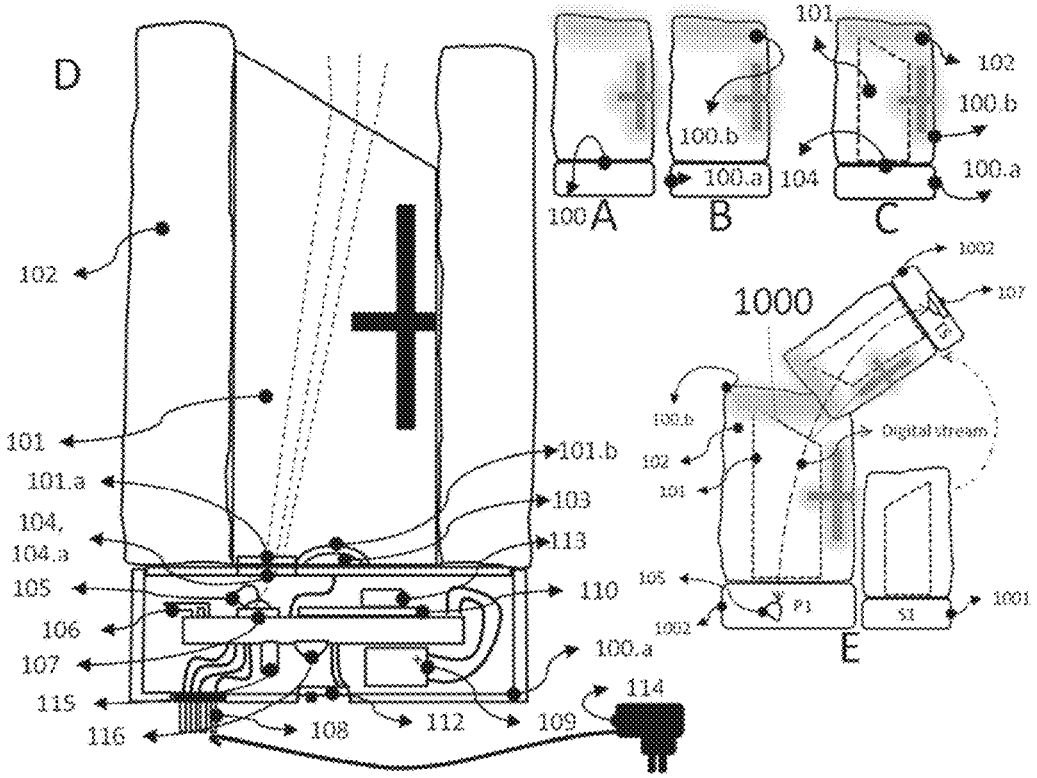
FIG. 1 shows the optical unit 100 (FIG. 1A), the two functional parts that make it up (FIG. 1B), the three functional parts that make up the upper section 100.*b* (FIG. 1C), the functional parts that make up the entire unit (FIG. 1D), the gestural-ritual turn on method (FIG. 1E)

Reference numeral 100 indicates as a whole an optical unit of a preferred, non-limiting embodiment of a unit for the gestural-ritual control of sending/receiving commands (by way of non-limiting example, turning on and off) between devices (by way of non-limiting example, light sources) provided with said unit.

Said unit comprises: at least one photo-emitter device 105, at least one photo-detector device 107 optimized for detecting the emission spectrum of the photo-emitter 105, at least one upper part 100.*b* intended for limiting and confining the optical radiation, said upper part comprising at least one of the following three components: a cover 104 provided with an opening, a coating 102 of any material adapted to restrict the optical radiation (by way of non-limiting example, metal, wood, plastic, frosted glass, wax), an optical guide 101 (by way of non-limiting example, of glass or plastic material).

Figure 3:
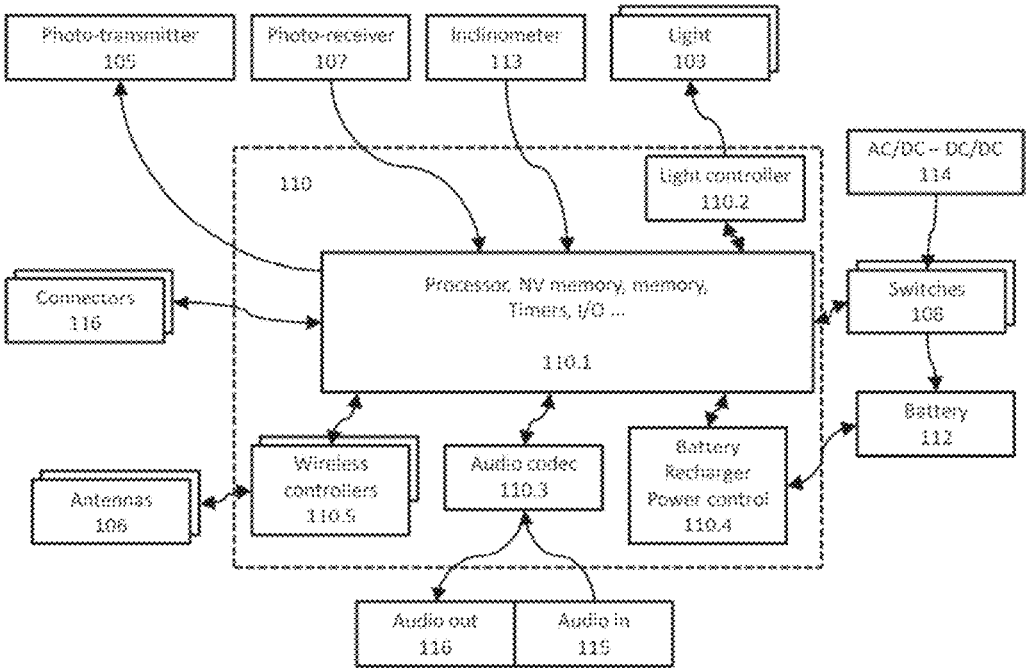
FIG. 3 shows the electric and electronic functional components of the optical unit 100 and their functional connection.

The photo-emitter device 105 (preferably non-limitingly emitting in the near infrared spectrum) is guided by a processing and control unit 110 (described in FIG. 3 by a preferred and non-limiting functional diagram). This unit 110 transmits via the photo-emitter 105 a digital sequence suitably encoded to contain sequences of commands and data. The radiation emitted is suitably limited and guided by the three components that can be provided in section 100.*b*.

Figure 2:
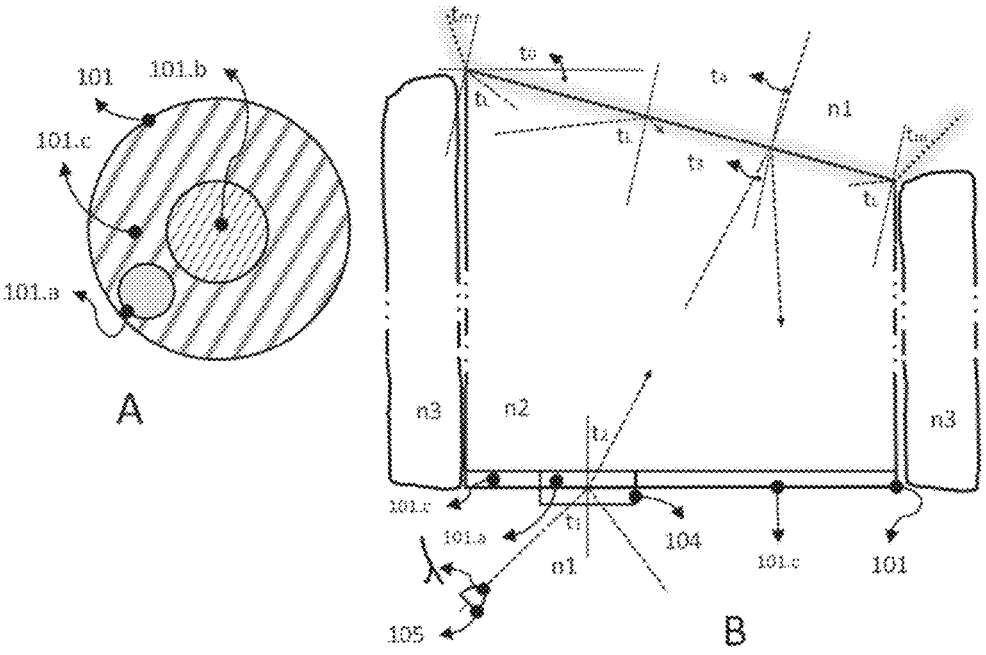
FIG. 2 shows the detail of the functional parts that make up the base of the optical guide 101 (FIG. 2A), and the functional parts that make up the optical path (FIG. 2B) with highlighted the technical parameters involved for defining the upper emission cone of the optical radiation.

Cover 104 provided with an opening limits the possible opening angle of the optical radiation. The optical guide 101 carries the optical radiation from the lower base to the upper one, varying the output angle and the power of the radiation according to the known laws of optics. Coating 102 limits the power of the optical radiation that could come out from the sides of unit 100, such a limitation being achieved both by absorption and by reflection and dispersion. FIG. 2 shows all the optical and physical parameters and variables involved in the process. By modulating one or more of said parameters and variables, an area of optical radiation is achieved that is properly confined in the upper part of unit 100.

The photo-detector device 107 receives the optical radiation emitted by the photo-emitter 105 of another unit. The output of 107 is acquired by the processing and control unit 110 that decodes the digital sequence.

To further limit the usable space of interaction between two optical units 100, so as to force the user to make a gesture similar to the lighting of a candle with another candle (as described in FIG. 4A), circuitry 110.1 reduces the optical power emitted by the photo-emitter 105 and limits the sensitivity of the photo-detector 107.

Section 110 of unit 100 includes: an acquisition, processing and control unit 110.1 (which in addition to driving 105 and acquiring 107 has the ability to handle I/O, store digital data in volatile and non-volatile form, manage timing), a connection and control section 110.4 of an external or internal power source, a circuitry 110.2 for the management and implementation (by way of non-limiting example, turning a light source on and off). The external power source of section 110.4 can optionally arrive from an AC-DC or DC-DC adapter 114 cut out by a switch 108.

Figure 4:
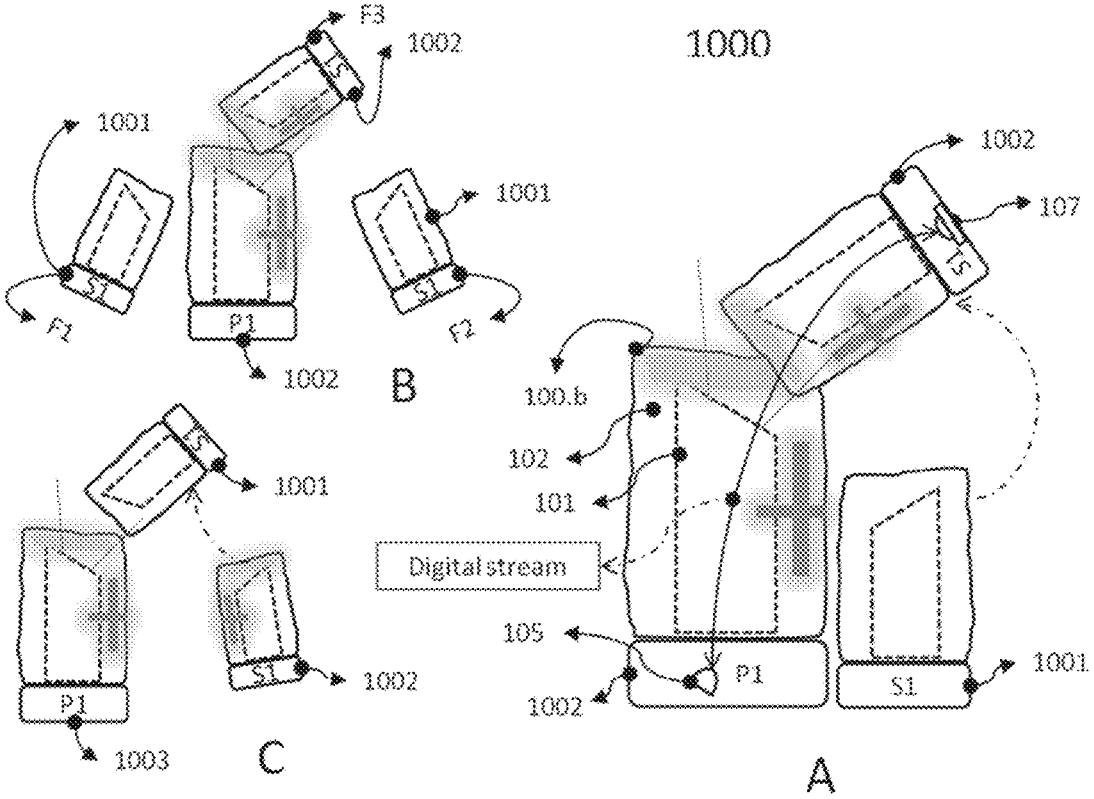
FIG. 4 shows the gestural-ritual turn on system that includes the units and the methodology 1000, detailing the gestures necessary to create an optical path useful to exchange data between the units (FIG. 4A), the areas of action/inaction of the unit (in FIG. 4B a data link is created only with the unit in position F3), the change in state of the optical units 100 associated with the gestural-ritual methodology (FIGS. 4A, 4B and 4C)

By using the above components, when the user sets two units 100 as shown in FIG. 4A, an optoelectronic communication channel is established between the two units. Through this communication channel, the present invention implements a method 1000 of sending and receiving commands, such a method comprising:

a system with at least two optical units 100, said units being in one of three states "STANDBY" 1001, "ACTIVE" 1002, "BLOW" 1003.

A unit 100 is in "STANDBY" state 1001 when it is ready to receive a command via the electro-optic channel and has the management circuitry 110.2 inactive. A unit in "STANDBY" 1001 can be set to "ACTIVE" state 1002 when one of the following events occurs: it is forced to the "ACTIVE" state through one of the I/O of the acquisition, processing and control unit (110.1), or when it receives an activation command from a second optical unit 100 in "ACTIVE" state 1002 via the optoelectronic input link (107+limiter-conveyer 102.*b*) during a ritual-gestural coupling (FIGS. 4A and 4B). The unit in "STANDBY" may, upon receiving a command, send to the "ACTIVE" unit via the optoelectronic output link (105+limiter-conveyer 102.*b*) a confirmation response that may contain data.

An optical unit 100 in "ACTIVE" state has the management circuitry 110.2 active and periodically sends an activation command via the electro-optical output channel (105+limiter-conveyer 102.*b*), enabling the optical reception from the electro-optical input link (107+limiter-conveyer 102.*b*) between one command sent and the other. An optical unit 100 in "ACTIVE" state is set to "STANDBY" state 1001 when at least one of the following events occurs: it receives at least one deactivation command emitted by a second unit 100 in "BLOW" state 1003 in response to its activation command, or is forced to the "STANDBY" state by one of the I/O of the acquisition, processing and control unit 110.1.

An optical unit 100 in "BLOW" state 1003 sends via the optical-electronic channel (105+limiter-conveyer 102.*b*) a deactivation command in response to the reception, via the optical-electronic channel (107+limiter-conveyer 102.*b*), an activation command sent by a unit in "ACTIVE" state 1002. A 100 unit is set to the "BLOW" state when at least one of the following events occurs: the state of "BLOW" is programmed into the acquisition, processing and control unit 110.1 memory or is forced to the "BLOW" state by one of the I/O of the acquisition, processing and control 110.1.

The method 1000 of the present invention, described above, implements a master-slave system that can be schematized by describing it (by way of non-limiting example) as a system of traditional candles.

A lit candle is in "ACTIVE" state, a blown candle is in "STANDBY" state, a candle blow is in "BLOW" state. The blown-slave candle ("STANDBY") can be lit only by a lit-master candle ("ACTIVE"). The lit-master candle (ACTIVE) can be blown only by a blown-slave candle (BLOW).

The optical unit 100, described above, implements the gestures to create the link by combining the electrical-electronic circuitry of section 100.*a*, with a passive optical section 100.*b* whose task is to limit and convey the optical radiation. Said section 100.*b* may be composed of at least one of the three components: optical guide 101, material 102 or a cover with an opening 104. Advantageously, said section 100.*b* can contain at least two of the three components (optical guide 101, material 102 or a cover with an opening 104), of which at least one of the two is the cover with opening 104. Such a cover 104 can advantageously accommodate in the opening at least one optical filter 104.*a* adapted to limit the optical spectrum not belonging to the emission spectrum of the photo-emitter 105, before exciting the photo-detector-107.

Moreover, said section 100.*b* can advantageously contain at least two of the three components (optical guide 101, material 102 or a cover with an opening 104), of which at least one of the two is the material 102 which advantageously has the task of laterally limiting to the optical unit 100 the optical power per unit area of the photo-emitter.

Moreover, said section 100.*b* can advantageously contain at least two of the three components (optical guide 101, material 102 or cover with opening 104), of which at least one of the two is the optical guide 101 which advantageously has the task of guiding and containing the optical path, varying according to the known laws of optics the parameters detailed in FIG. 2B: the beam emitted by 105 impinges with angle t1 on 101, is refracted in the guide with angle t2, impinges in the upper part of the guide with angle t3 (related to the inclination t0 of the upper part of 101) and is refracted with angle t4. The maximum angle past which the beam does not exit (tm) is a function of the limit angle tL. All angles t2, t4 and tL (as well as the reflected and refracted powers) are also functions of the refractive indices of the materials (n1 and n2). Advantageously, the optical guide 101 (FIG. 2A) may have in the lower part a zone 101.*a* that minimizes the dispersion (and thus the inner beams with too distributed directions). The optical guide 101 can also advantageously have a surface 101.*b* intended for the optical coupling of at least one light source 103 advantageously located between 100.*a* and 100.*b* (FIG. 1) and advantageously controlled (in intensity and color) by the management circuitry 110.2. This surface 101.*b* advantageously modulates (by increasing or decreasing) the visible light scattering within the optical guide, by varying the visible light dispersed by the side of the unit (by way of non-limiting example, by illuminating the material 102, if present). The optical guide 101 can also advantageously have a surface 101.*c* that is reflective to visible light and to the radiation in the optical spectrum of 105. This reflective surface has two tasks: the first is to function as an optical cavity which limits the power of visible light dispersed in the lower part of unit 100 (by increasing the optical performance of the optical unit 100 when provided with internal light source). The second is to generate, for the beams of the optical radiation incident directly on 101.*a* and 104.*a* multiple reflections that reduce the optical power transmitted in the lower part of 100 (100.*a*), acting as additional optical power limiter for links 105-107 that are established between two optical units 100 and thus limiting the undesired "turning on" that do not correspond to the ritual gestures.

Moreover, to further limit the turning on to more limited gestures, the optical unit 100 can advantageously be provided with at least one inclinometer 113 that enables the operation only when the two optical units 100, exchanging the inclination value as one of the digital data of method 1000, form an angle between them that is comprised within two precise limits (by way of non-limiting example, between 135 and 225 degrees).

The optical unit 100 may further be provided with at least one internal battery 112 connected to the connection and control circuitry 110.4 of the power source which in this case will also work as a charger, if connected to an external power source 114.

Moreover, since the activation status of a unit 100 is not limited to the control of light sources, said optical unit 100 can advantageously also include an audio section 110.3. Said audio section can advantageously acquire at least one audio input 115. Said audio section can also advantageously manage at least one audio output 116.

By way of non-limiting example, let's think of a light with included an audio speaker that is switched on by the optical unit 100 and the gestural-ritual candle lighting method 1000.

Moreover, since by using the optical unit 100 and method 1000 it is possible to create local networks of objects according to method 3000 and digital service interconnections between objects according to method 2000, unit 100 can be advantageously be provided with at least one electronic circuitry 110.5 for wireless connection (by way of preferred non-limiting embodiment, WiFi, Bluetooth, 802.11.4), which can advantageously be provided with at least one antenna 106.

Moreover, since the optical unit 100 can expand its functionalities or connect to other similar units via wired connection, said unit 100 can advantageously be provided with at least one interconnection section 108.

Figure 6:
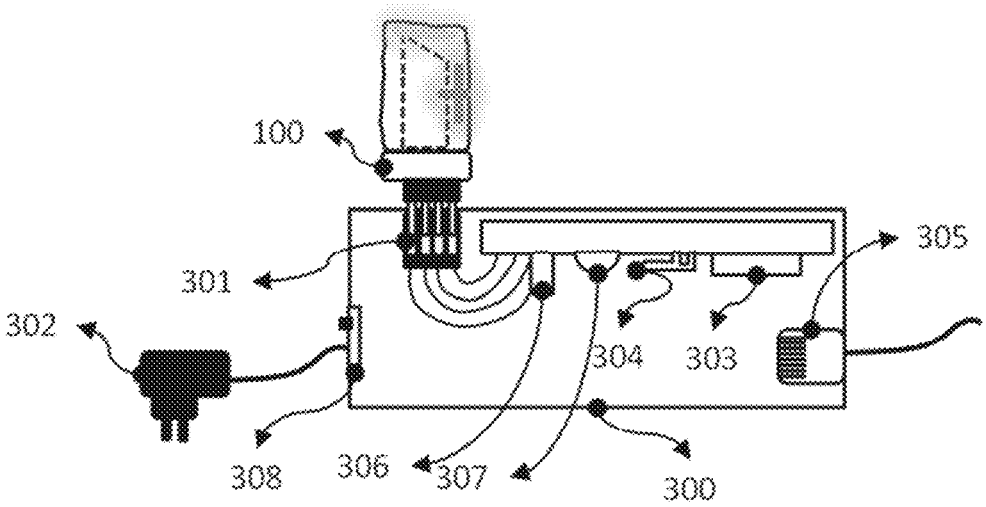
FIG. 6 shows the functional components of the expansion unit 300.
Figure 7:
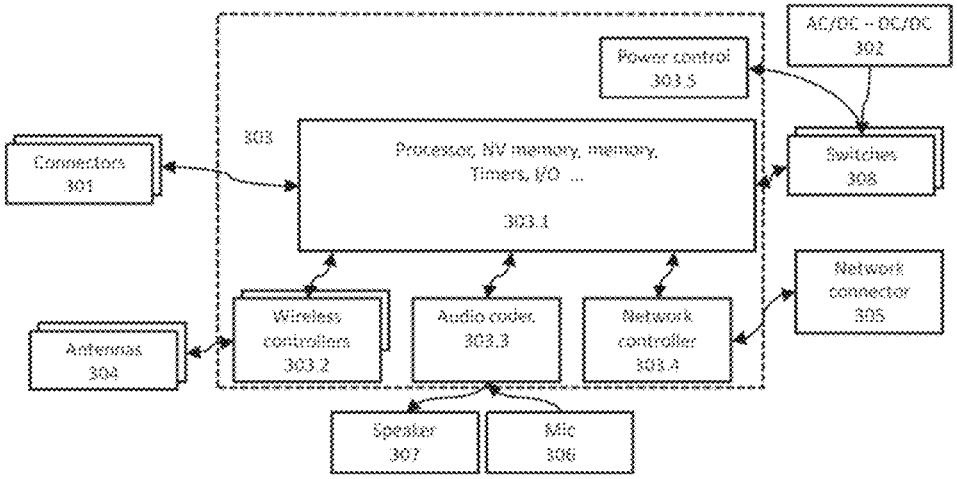
FIG. 7 shows the electrical and electronic components of the expansion unit 300.

A unit 100 provided with interconnection 108 can be advantageously connected to an expansion unit 300 (FIGS. 6 and 7) provided with at least one interconnection section 301 thereof (which is combined with 108 of unit 100) and at least one of processing and control section 303 thereof provided with at least one connection and control section 303.5 of a power source (internal or external) and at least one acquisition, processing and control unit 303.1 with the ability to manage I/O, store digital data in volatile and non-volatile form. The external power source of section 303.5 can optionally arrive from an AC-DC or DC-DC adapter 302 cut out by a switch 308.

Said expansion unit 300 may advantageously be provided with at least an electronic circuitry 303.2 thereof for wireless connection, since in this case it can advantageously have at least one antenna 304 thereof.

Said expansion unit 300 may advantageously be further provided with at least one circuitry for the wired connection to a digital communication network 305.

Said expansion unit 300 may advantageously be provided with at least one audio input 306 connected through special circuitry 303.3 to the processing and control unit 303.

Said expansion unit 300 may advantageously be provided with at least one audio output 307 connected through special circuitry 303.3 to the processing and control unit 303.

Unit 300 described above has a function of expansion of the basic optical unit 100 that can delegate part of the functions to the expansion unit 300 that it may in any case have internally. Let's think (by way of non-limiting example) to a system that controls through the unit 100 the gestural-ritual method 1000 and method 3000 method (described hereinafter) groups of audio speakers connected to the local digital network. Using the system 100+300 it is possible to: remove unit 100 in ACTIVE state (with its own internal battery 112) from its expansion unit 300 containing the speaker, and with this optical unit 100 "turn on" other speakers that will be added to a functional group through method 1000 and method 3000 of the present invention.

Figure 8:
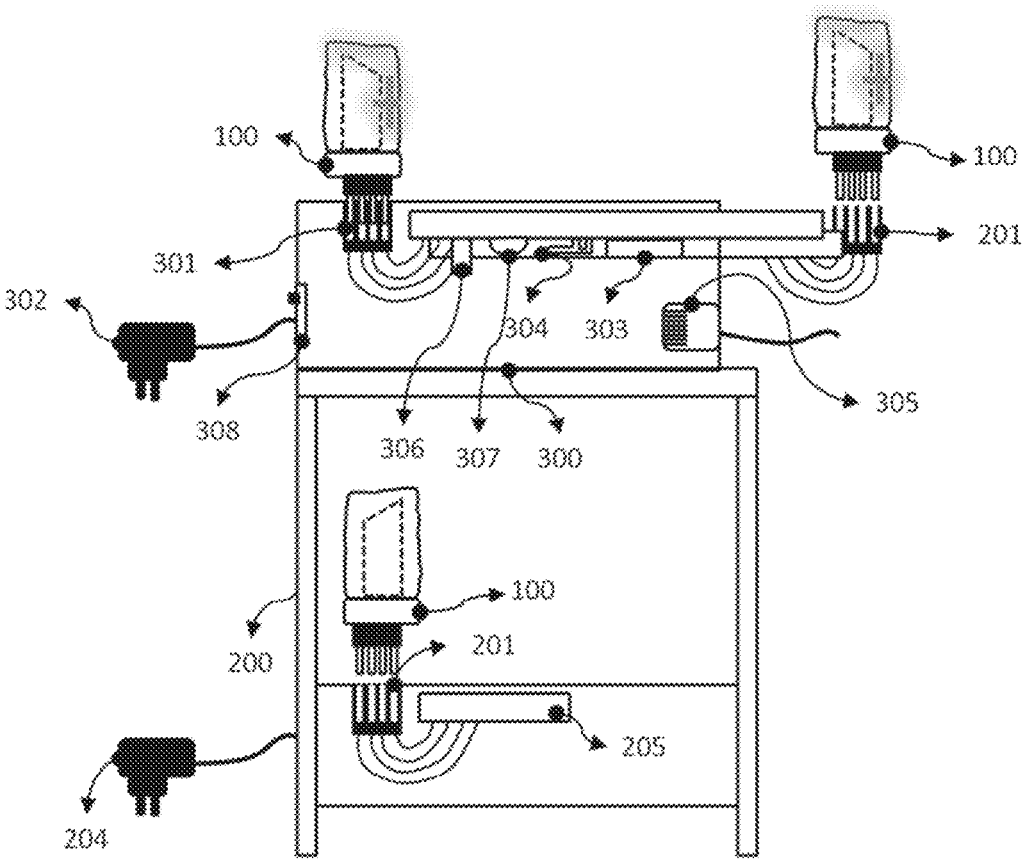
FIG. 8 shows the functional components of the candle-holder-like unit 200.
Figure 9:
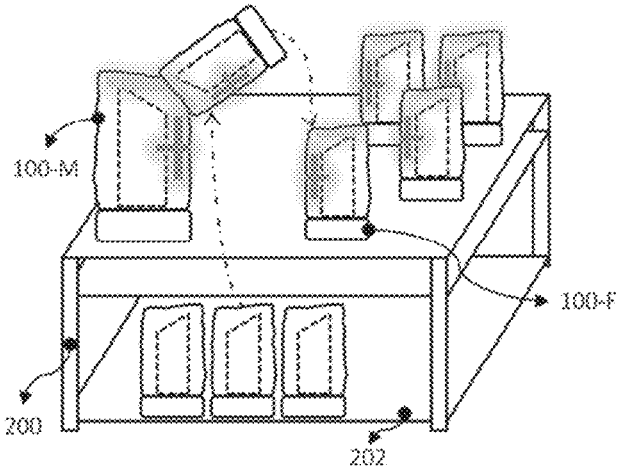
FIG. 9 shows the operation of the candle-holder-like unit 200.

Multiple units 100 can then conveniently share the same expansion unit 300 at the same time, which in this case will be described as units in the shape of a candle holder 200 consisting of at least one expansion unit 300 and at least two units 100 connected to the processing and control unit 303 through at least one additional interconnection section 201 (FIGS. 8 and 9). Said unit in the shape of a candle holder 200 can advantageously have a charging circuitry 205 intended to recharge units 100 at that time not connected to the expansion unit 300, said charging circuitry being optionally connectable to the mains supply via an external adapter 204.

By way of non-limiting example, through the unit in the shape of a candle holder 200 thus described it is possible to combine multiple optical units 100 into a single electronic votive candle holder (FIGS. 8 and 9). The candle holder has a unit 100 in the ACTIVE state according to method 1000 connected to unit 300. Units 100 provided with their own internal battery 112 (electronic candles in the present illustrative non-limiting example) still not lit according to method 1000, are placed in the lower part of 200 in "STANDBY" state according to method 1000 and connected to the charging circuitry 205. A devotee who wants to light one of these optical units 100 in the shape of a candle, removes it from the lower part, lights it by the gestural ritual method 1000 with a lit candle (in "ACTIVE" state according to method 1000) already present in the upper part and puts it in the upper part of the candle holder by connecting it to 300 through an interconnection 201.

By the gestural-ritual control method 1000 (this method comprising single units 100 or combined with 300 and 200), it is possible to establish states and communication channels that allow making the definition of higher order services normally much more complex fast and easy.

According to the present invention, method 2000 is described (FIGS. 5A, 5B and 5C) that advantageously allows creating groups of objects also in mutually remote locations which exchange digital services, said groups being connected to such services via a local or remote, single or distributed server 2004. These services may, by way of non-limiting example, be based on publish subscribe protocols (preferably but non-limitingly, MQTT), or be audio streaming services, or services provided via API. Method 2000 described hereinafter allows, using method 1000, a simple and immediate transfer from one unit (100, 200 or 300) to the other of all the parameters and permissions needed to establish the service exchange link. By way of non-limiting example, in case of MQTT messaging, using method 1000 and 2000 two units 100, 200 or 300 can advantageously exchange the network address of the MQTT broker present on 2004, the TOPIC MQTT to be subscribed, the USER and PW needed to be enable to the subscription.

Method 2000 (FIGS. 5A, 5B and 5C) advantageously includes: a) at least two units (referred to as first unit P2 and second unit S2) in one of three preferred and non-limiting embodiments 100, 200 or 300, and in one of the states of method 1000: "STANDBY" (1001), "ACTIVE" (1002), "BLOW" 1003. *b*) at least one local or remote, single or distributed server 2004, through which said units establish a network connectivity or publish and subscribe to digital services using the parameters that the first unit P2 and the second unit S2 exchange by method 2000, receiving from the same server 2004 any higher order authorizations necessary for such publications and subscriptions.

According to method 2000, said units P2 and S2 can advantageously be in one of following three states: "MOTHER" state 2001, "CHILD" state 2002, "CHILD GROUP" state 2003.

Advantageously, the units described above in method 2000 can be set to one of three states "MOTHER" 2001, "CHILD" 2002, "CHILD GROUP" 2003, through a code that qualifies them as "MOTHER" or "CHILD" or "CHILD GROUP", such a code being able to be stored to the memory or acquired through an I/O of the processing and control unit 110.

Advantageously, the units described above have a personal ID code stored in the non-volatile memory of the processing and control unit 110.

The "MOTHER" state 2001 advantageously also includes different capacities described hereinafter that depend on the "ACTIVE" 1002 or "STANDBY" 1001 1002 state in which it is according to method 1000, and on the states of the units with which it interacts.

Advantageously, a first unit P2 in "MOTHER" state 2001 and in "ACTIVE" state 1002 has the ability to send to a second unit S2, via the data link established during the sequence of sending/receiving gestural-ritual commands of method 1000, an identification command like "MOTHER" together with the identification code and also has the ability to transmit, via the data link established during the sequence of sending/receiving gestural-ritual commands of method 1000, to a second unit S2 in "CHILD" state 2002 and in "STANDBY" state 1001 all the parameters needed to establish between them (first unit P2 and second unit S2), through server 2004, a network connectivity or to subscribe to digital services connected to the first unit P2 "MOTHER" to the subscription of which the second unit S2 "CHILD" is enabled. Advantageously, a first unit P2 in "MOTHER" state 2001 and in "STANDBY" state 1001 has the ability to be set to the "ACTIVE" state 1002, via the sequence of sending/receiving gestural-ritual commands as per method 1000, from any second unit S2 (either "MOTHER" 2001 or "CHILD" 2002) in "ACTIVE" state 1002, without sending to the second unit S2 all the parameters needed to establish network connectivity or to subscribe to digital services and without importing the same parameters from the second unit S2, if in "MOTHER" state 2001.

The "CHILD" state 2002 advantageously also includes different capacities described hereinafter that depend on the "ACTIVE" 1002 or "STANDBY" 1001 state in which it is according to method 1000, and on the states of the units with which it interacts.

Advantageously, a first unit P2 in "CHILD" state 2002 and in "STANDBY" state 1001 has the ability to be set to the "ACTIVE" state 1002, via the sequence of sending/receiving gestural-ritual commands as per method 1000 from any second unit S2 "MOTHER" 2001 in "ACTIVE" state 1002 by receiving, via the data link established during the sequence of sending/receiving gestural-ritual commands as per method 1000, from the second unit S2 all the parameters needed to establish between them (first unit P2 and second unit S2), through server 2004, a network connectivity or to subscribe to digital services connected to the second unit S2 to the subscription of which the first unit P2 is enabled.

Advantageously, a first unit P2 in the "CHILD" state 2002 in "STANDBY" state 1001 has the ability to be set to the in "ACTIVE" state 1002, via the sequence of sending/receiving the gestural-ritual commands as per method 1000, from any second unit S2 "CHILD" 2002 in "ACTIVE" state 1001, receiving, via the data link established during the sequence of sending/receiving the gestural-ritual commands as per method 1000, from the second unit S2 at least one group of parameters that said second unit S2 has previously imported by method 2000.

Advantageously, a first unit P2 in the "CHILD" state 2002 in "ACTIVE" state 1002 has the ability to send to a second unit S2, via the data link established during the sequence of sending/receiving the gestural-ritual commands as per method 1000, an identification command as "CHILD" unit provided with the identification code and also has the ability to send to a second unit S2 in "CHILD" state 2002 in "STANDBY" state 1001, via the data link established during the sequence of sending/receiving gestural-ritual commands as per claim 1, at least one group of the parameters that said first unit P2 has previously imported by method 2000.

Finally, the "CHILD GROUP" state (2003) advantageously comprises all the capabilities related to the "CHILD" state described above and advantageously the following additional capabilities:

- The capability when the first unit P2 is in "CHILD GROUP" state 2003 and in "ACTIVE" state 1001 to send to a second unit S2, via the data link established during the sequence of sending/receiving gestural-ritual commands of method 1000, an identification command like "CHILD GROUP" together with the identification code and to transmit, via the data link established during the sequence of sending/receiving gestural-ritual commands as per claim 1, to a second unit S2 in "CHILD" state 2002 and in "STANDBY" state 1001 at least a group of parameters needed to establish between them (first unit P2 and second unit S2), through server 2004, a network connectivity or to subscribe to digital services connected to it (first unit P2) to the subscription of which the second unit S2 is enabled.
- The capability through server 2004 to publish services and establish links with all "CHILD" units enabled which it has set from "STANDBY" state to "ACTIVE" state during the sequence of sending/receiving gestural-ritual commands as per method 1000.

Figure 5:
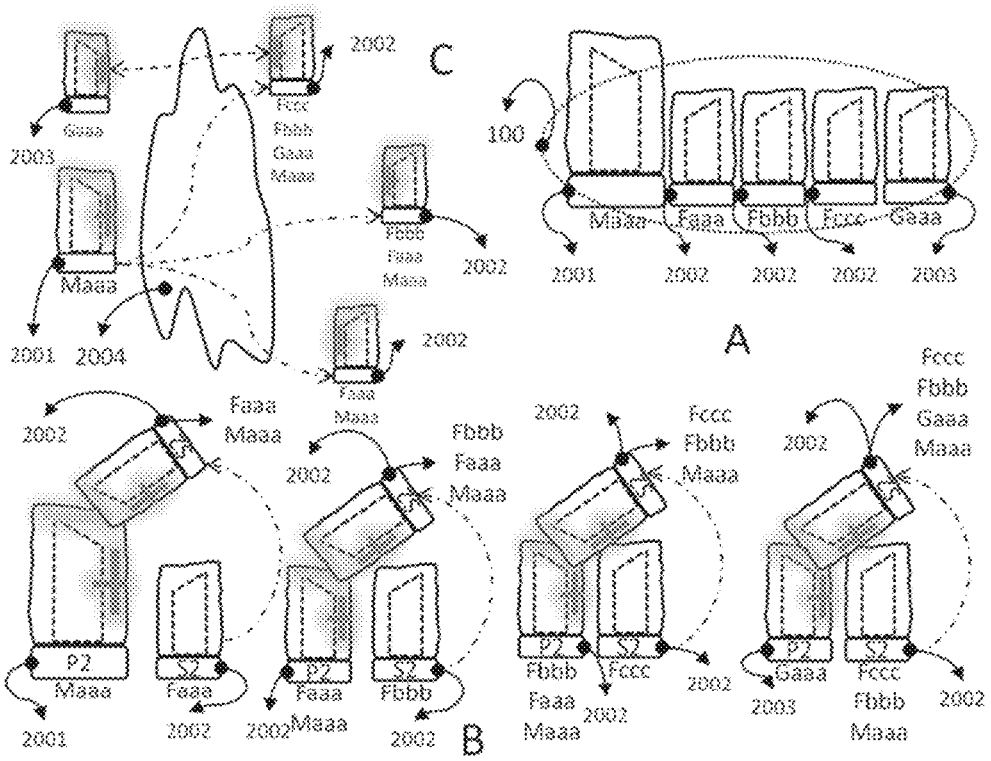
FIG. 5 shows the method (2000) for creating groups of interconnected units that publish and subscribe to services, detailing the type of units involved (FIG. 5A), the methodological process of transfer and distribution of properties (FIG. 5B), the distributed system created using the example shown in FIG. 5B (FIG. 5C)

A non-limiting example of method 2000 is the one that refers to FIGS. 5A, 5B and 5C. The system consists of a unit in MOTHER state 2001 (Maaa), 3 optical units 100 in CHILD state 2002 (Faaa, Fbbb, Fccc) and a unit in CHILD GROUP state 2003 (Gaaa). The MOTHER unit Maaa is an optical unit 100 in the shape of an electronic candle set permanently lit at a Sanctuary that broadcasts masses in audio streaming and during special occasions changes the color of the electronic candles. For example, on the day of the anniversary of the Saint of the Sanctuary, the perennial candle placed near the Tomb turns red to remember the martyrdom. The perennial candle color state is published as MQTT message by server 2004. A believer buys an optical unit 100 CHILD Faaa. Using the gestural-ritual method 1000, he lights it at the Saint's Tomb using the candle MOTHER Maaa. The candle MOTHER Maaa through 1000 passes it all the parameters and the service catalog: the audio streaming channel of liturgies, the TOPIC MQTT, the addresses of remote servers 2004 where the Broker MQTT resides, the subscription authorizations for TOPIC MQTT of the Sanctuary. The candle CHILD Faaa now has its Faaa properties and the properties imported from MOTHER Maaa. The candle Faaa when connected to the internet (by way of non-limiting example in the configuration of optical unit 100 with 110, 116, 110.5 and 106, or in the configuration of unit 100 combined with unit 300 with 301, 303, 303.2 2 304, 307) remains synchronized with the services of the Sanctuary: the streaming is broadcast by speaker 116 of Faaa, light 103 of Faaa turns RED with light MOTHER Maaa on the day of the anniversary. Another believer, at another time and in another place, lights his candle CHILD Fbbb according to method 1000 using candle CHILD Faaa, importing all native and acquired properties thereof (Maaa, Faaa). Also the second candle CHILD Fbbb since that moment will be synchronized with the services of the Sanctuary. In the same way, candle Fccc will import the properties of Fbbb.

Another user has an optical unit 100 in the shape of a candle Gaaa in CHILD GROUP state 2003 and wants to create a prayer group (bi-directional audio streaming) with the user holding the candle CHILD Fccc. To do so, the candle Fccc is lit with candle CHILD GROUP Gaaa thereby importing the properties, streaming service server addresses and relative permissions.

At the end of process 2000, the system through servers 2004 will be configured as follows: candles Faaa, Fbbb and Fccc are synchronized with the services of Sanctuary by candle Maaa. Candle Fccc is in turn connected to the bidirectional audio services of the group referred to the candle Gaaa.

As is seen, with the invention object of the present patent, in order to create a complex scenario it is sufficient to intuitively light (like one would with a real candle) the electronic candles 100 with one another (those blown with those lit). It is noted that the intuitive rituality of the gesture is maintained, and the ancestral ritual potential thereof is amplified since the child candles mutually transmitted the holy light of the Sanctuary (from the mother to the first, from the first to the second, and so on).

According to the present invention, units 100, either single or combined with expansion units 200 or 300, and method 1000 can advantageously be used with method 3000 that will be described hereinafter to create in a simple, intuitive and secure manner local networks of objects connected to the digital network, configuring them on the local network, by assigning them to one or more functional groups, giving them access to the digital network (either local or remote).

Such a method 3000 (FIGS. 10 to 19) comprises a system with at least two of the following units that will be referred to as first unit P3 and second unit S3, said units advantageously comprising also the capabilities of method 1000 and its states "STANDBY" 1001, "ACTIVE" 1002, "BLOW" 1003:

- a gestural-ritual control unit 100 in any of the configurations described above comprising at least one of the following features: circuitry 110.5 for wireless connection or an expansion connector 108.
- a gestural-ritual control unit 300 in the embodiment 300 described above.
- a gestural-ritual control unit 300 in the embodiment 200 described above.

Advantageously, one of the units described above can, in method 3000, take at least one of the following states: "GATEWAY" 3001, "NODE" 3002, "MATCHSTICK" 3003, "SNUFFER" 3004.

Said method 3000 also comprises:

- at least one local network of objects 3006 defined as the digital network, either wired or wireless, which digitally connects with one another at least two of the above units;
- optionally at least one local or remote network 3007, either wired or wireless, defined as a digital network different from the network of objects 3006;
- optionally at least one external device 3005, by way of non-limiting example a PC, a computer, a tablet or a smartphone, such a device being connected to the local network of objects 3006 or to local or remote network 3007.

Advantageously, one of the units described above in method 3000 can be set to one of four states "GATEWAY" 3001, "NODE" 3002, "MATCHSTICK" 3003, "SNUFFER" 3004 through a code that qualifies it as "GATEWAY"○"NODE"○"MATCHSTICK"○"SNUFFER", such a code being able to be stored to the memory of the unit or acquired through an I/O of the processing and control unit 110.

Advantageously, the units described above can, by using method 3000, be assigned to multiple functional groups, defining a functional group "GROUP" 3008 as a set of at least two units that can be controlled simultaneously with a single command using, by way of non-limiting example, the external device 3005 defined above.

Advantageously, method 3000 comprises a default functional group "GROUP" 3008 indicated as "GROUP DEFAULT" 3008.1 comprising all the units described above that belong to the local network of objects 3006.

Advantageously, the state named "GATEWAY" 3001 for any of the above units includes the ability to regulate the communication and data exchange between objects of the local network of objects 3006, the optional ability to regulate communication and data exchange between the local network of objects 3006 and other local or remote networks 3007, the optional ability to regulate communication with an external device 3005 (PC, computer, tablet, smartphone), connected to the local network of objects 3006 or other networks 3007. Advantageously, a first unit P3 in the "GATEWAY" state 3001 comprises several abilities depending on the state of method 1000 in which it is.

Advantageously, when the first unit P3 is in "GATEWAY" state 3001 and in "ACTIVE" 1002 state, it has the ability to set to "ACTIVE" state 1002 any second unit S3 in the "NODE" state 3002 in "STANDBY" state 1001, transferring to the second unit S3, via the data link established during the sequence of sending/receiving gestural-ritual commands of method 1000, all the parameters and permissions to configure said second unit S3 "NODE" 3002, add it to the local network of objects 3006 and assign it to the "GROUP DEFAULT" group 3008.1 defined above.

Advantageously, when the first unit P3 is in "GATEWAY" state 3001 and in "ACTIVE" 1002 state, it has the ability to set to "ACTIVE" state 1002 any second unit S3 in the "MATCHSTICK" state 3003 in "STANDBY" state 1001, transferring to the second unit S3 "MATCHSTICK" 3003, via the data link established during the sequence of sending/receiving gestural-ritual commands of method 1000, all the parameters and permissions to allow said second unit S3 "MATCHSTICK" 3003 to configure other units "NODE" 3002, add them to the local network of objects 3006 and assign them to the "GROUP DEFAULT" group 3008.1 defined above.

Advantageously, when the first unit P3 is in "GATEWAY" state 3001 and in "ACTIVE" state 1002, it has the ability to be set to "STANDBY" state 1001 by any second unit S3 in "SNUFFER" state 3004 in "BLOW" state 1003, receiving from the second unit S3 "SNUFFER" 3004 via the data link established during the sequence of sending/receiving gestural-ritual commands per method 1000 a clearing command of the list of units assigned to the local network of objects 3006 of groups "GROUP" 3008 defined above to which said units belonged.

Another state that the units described above can take is the "NODE" state 3002.

Advantageously, a first unit P3 in the "NODE" state 3002 comprises several abilities depending on the state of method 1000 in which it is.

Advantageously, when the first unit P3 is in "NODE" state 3002 and in "STANDBY" 1001 state, it has the ability to be set to "ACTIVE" state 1002 by any second unit S3 in the "GATEWAY" state 3001 in "ACTIVE" state 1002, receiving from the second unit S3, via the data link established during the sequence of sending/receiving gestural-ritual commands of method 1000, all the parameters and permissions to be configured and added to the local network of objects 3006 and be assigned to the "GROUP DEFAULT" group 3008.1 defined above.

Advantageously, when the first unit P3 is in the "NODE" state 3002 and in the "STANDBY" state 1001, it has the ability to be set to the "ACTIVE" state 1002 by any second unit S3 in "ACTIVE" state 1002 in "MATCHSTICK" state 3003 or in "NODE" state 3002 (in this second case, S3 must already be assigned to the local network), receiving from the second unit S3, via the data link established during the sequence of sending/receiving gestural-ritual commands of method 1000, different parameters in the two cases a) and b) described below: a) if the first unit P3 is not yet assigned to the local network of objects 3006, it will receive all the parameters and permissions to be configured, added to the local network of objects 3006 and assigned to the "GROUP DEFAULT" 3008.1 group defined above; b) if the first unit P3 is already assigned to the local network of objects 3006, it will receive all the parameters and permissions to be assigned to the "GROUP" 3008 group of the other "NODE" units 3002 that interacted with the same second unit (S3) in the last period, said last period being the last time interval in which the second unit S3 switched from the "STANDBY" state 1001 to the current "ACTIVE" state 1002.

Advantageously, when the first unit P3 is in "NODE" state 3002 and in ACTIVE state 1002 and is already assigned to the local network of objects 3006, it has the ability to set any second unit S3 to "ACTIVE" state 1002 in the "NODE" state 3002 in "STANDBY" state 1001, transferring to the second unit S3, via the data link established during the sequence of sending/receiving gestural-ritual commands of method 1000, all the parameters and permissions to: a) if said second unit S3 is not yet assigned to the local network of objects 3006, configure it, add it to the local network of objects 3006 and assign it to the "GROUP DEFAULT" group 3008.1 defined above; b) if S3 is already assigned to the local network of objects 3006, assign it to the "GROUP" group 3008 of the other "NODE" units 3002 that interacted with the above first unit P3 in the last period, said last period being the last time interval in which the first unit P3 has switched from the "STANDBY" state 1001 to the current "ACTIVE" state 1002.

Advantageously, when the first unit P3 is in "NODE" state 3002 and in "ACTIVE" state 1002 and is already assigned to the local network of objects 3006, it has the ability to set any second unit S3 to "ACTIVE" state 1002 in the "MATCHSTICK" state 3003 in "STANDBY" state 1001, transferring to the second unit S3, via the data link established during the sequence of sending/receiving gestural-ritual commands of method 1000, all the parameters and permissions to configure, add to the local network of objects 3006 and assign to a "GROUP" group 3008 defined above, all the other "NODE" units 3002 that will interact with the same second unit S3 in the "MATCHSTICK" state 3003 in the subsequent period, the subsequent period being the time interval in which the second unit S3 in the "MATCHSTICK" state 3003 will remain in the "ACTIVE" state 1002 to which it is currently set.

Advantageously, when the first unit P3 is in "NODE" state 3002 and in "ACTIVE" state 1002, it has the ability to be set to "STANDBY" state 1001 by any second unit S3 in "SNUFFER" state 3004 in "BLOW" state 1003, receiving from the second unit S3 via the data link established during the sequence of sending/receiving gestural-ritual commands of method 1000 at least one command either to be deleted from the local network of objects 3006 or to be deleted from any "GROUP" group 3008.

Another state that the units described above can take is the "MATCHSTICK" state 3003.

Advantageously, a first unit P3 in the "MATCHSTICK" state 3003 comprises several abilities depending on the state of method 1000 in which it is.

Advantageously, when the first unit P3 is in "MATCHSTICK" state 3003 and in "STANDBY" 1001 state, it has the ability to be set to "ACTIVE" state 1002 by any second unit S3 in the "GATEWAY" state 3001 in "NODE" state 3002 in "ACTIVE" state 1002, receiving from said second unit S3, via the data link established during the sequence of sending/receiving gestural-ritual commands of method 1000, all the parameters and permissions to configure and add to the local network of objects 3006 or add to the "GROUP" groups 3008 other "NODE" units 3002.

Advantageously, when the first unit P3 is in "MATCHSTICK" state 3003 and in "ACTIVE" 1002 state, it has the ability to set to "ACTIVE" state 1002 any second unit S3 in the "NODE" state 3002 in "STANDBY" state 1001, sending to said second unit S3, via the data link established during the sequence of sending/receiving gestural-ritual commands of method 1000, all the parameters and permissions to be configured and added to the local network of objects 3006 or added to the "GROUP" groups 3008 with other "NODE" units 3002.

Another state that the units described above can take is the "SNUFFER" state 3004.

Advantageously, a first unit P3 in the "SNUFFER" state 3004 comprises several abilities depending on the state of method 1000 in which it is.

Advantageously, when the first unit P3 is in "SNUFFER" state 3004 and in "BLOW" state 1003, it has the ability to set to "STANDBY" state 1001 any second unit S3 in the "NODE" state 3002 or "GATEWAY" 3001 to the "ACTIVE" state 1002, sending to said second unit S3 via the data link established during the sequence of sending/receiving gestural-ritual commands of method 1000 at least one command either to be deleted from the local network of objects 3006 or to be deleted from any "GROUP" group 3008.

Using the described method 3000 that uses single units 100 or in the integrated embodiments of the expansion unit 300 and in the shape of a candle holder 200, it is possible to create systems of objects connected to the network of things in an intuitive manner.

In fact, apart from the inevitable rigorous description above, the system is based on the underlying concept of method 1000: the active units ("ACTIVE") transmit, through the electronics and methods described above, the properties to units that are turned on ("STANDBY"). Also in this case, a comparison with a traditional candle system simplifies the description.

Figure 10:
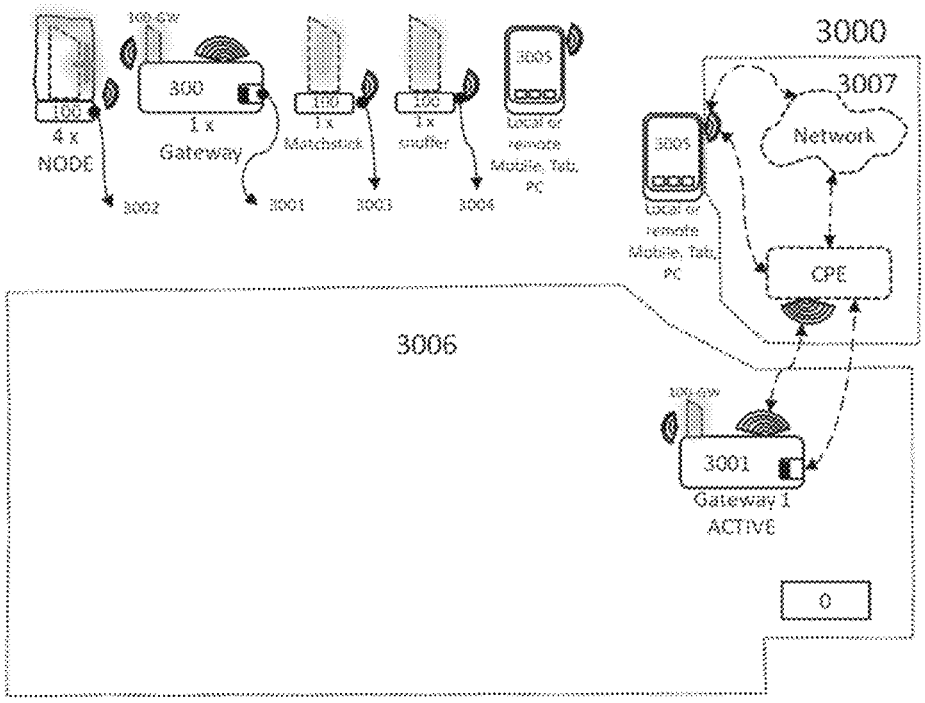
FIG. 10 shows the method (3000) for connecting to the network of objects (3006) of the units and for creating functional groups (3008) within the network of objects (3006). In particular.

FIGS. 10 to 19 describe the process. FIG. 10 shows the system of the example.

Figure 11:
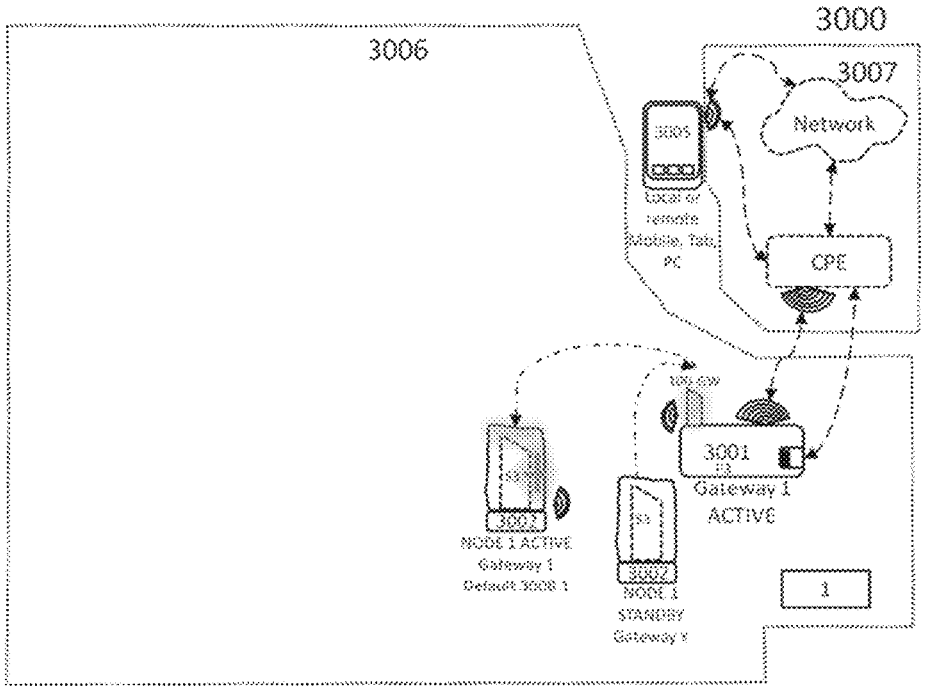
FIG. 11 shows the method (3000) for connecting to the network of objects (3006) of the units and for creating functional groups (3008) within the network of objects (3006). In particular.

FIG. 11 shows how to add a NODE 1 unit to network 3006, which is not yet present on network 3006, turning it on, as would be done with a GATEWAY candle, which through method 100 passes all the configuration parameters to it and associates it to the DEFAULT group.

Figure 12:
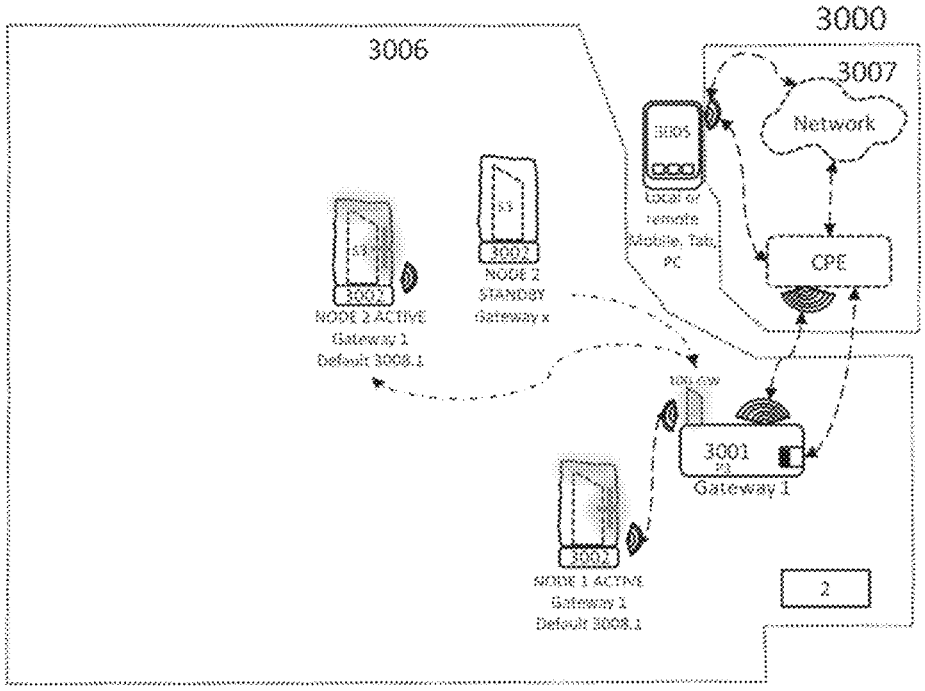
FIG. 12 shows the method (3000) for connecting to the network of objects (3006) of the units and for creating functional groups (3008) within the network of objects. In particular.

FIG. 12 shows the same mechanism for a second NODE 2 unit.

Figure 13:
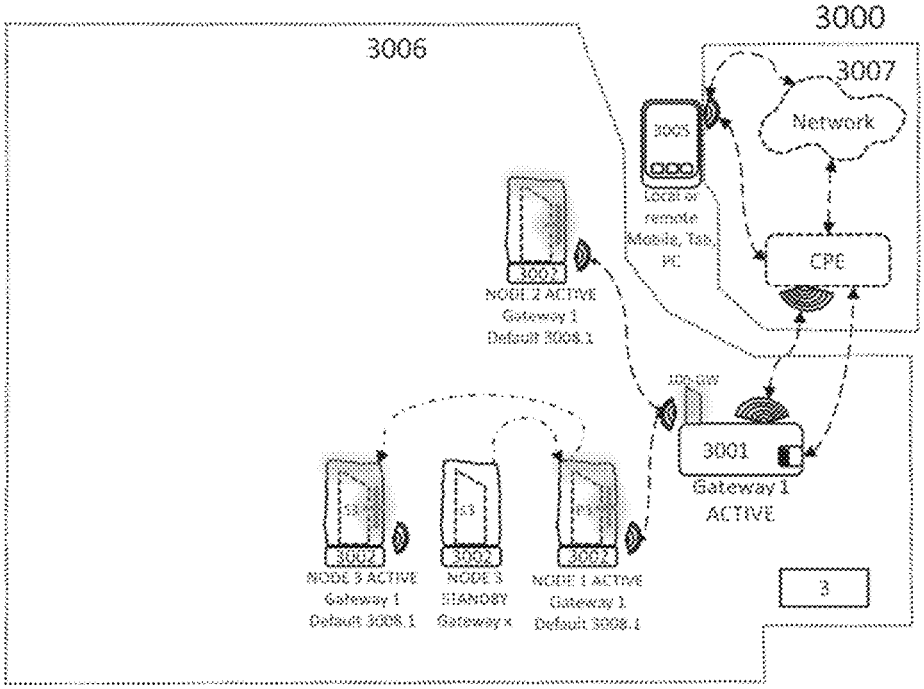
FIG. 13 shows the method (3000) for connecting to the network of objects (3006) of the units and for creating functional groups (3008) within the network of objects (3006). In particular.

FIG. 13 shows how an active NODE 3 unit with NODE 2 is added to network 3006.

Figure 14:
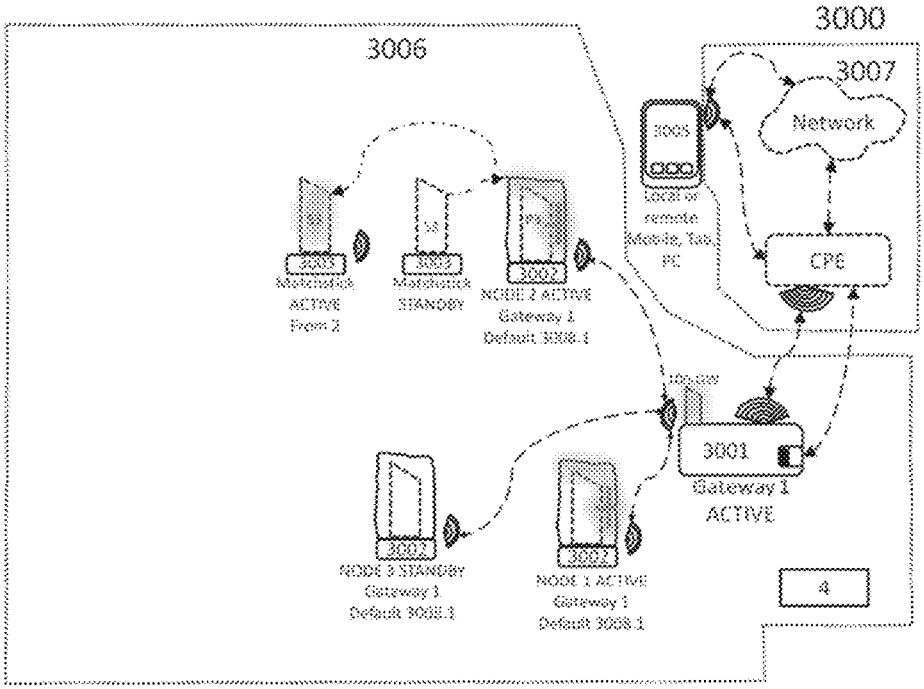
FIG. 14 shows the method (3000) for connecting to the network of objects (3006) of the units and for creating functional groups (3008) within the network of objects (3006). In particular.
Figure 15:
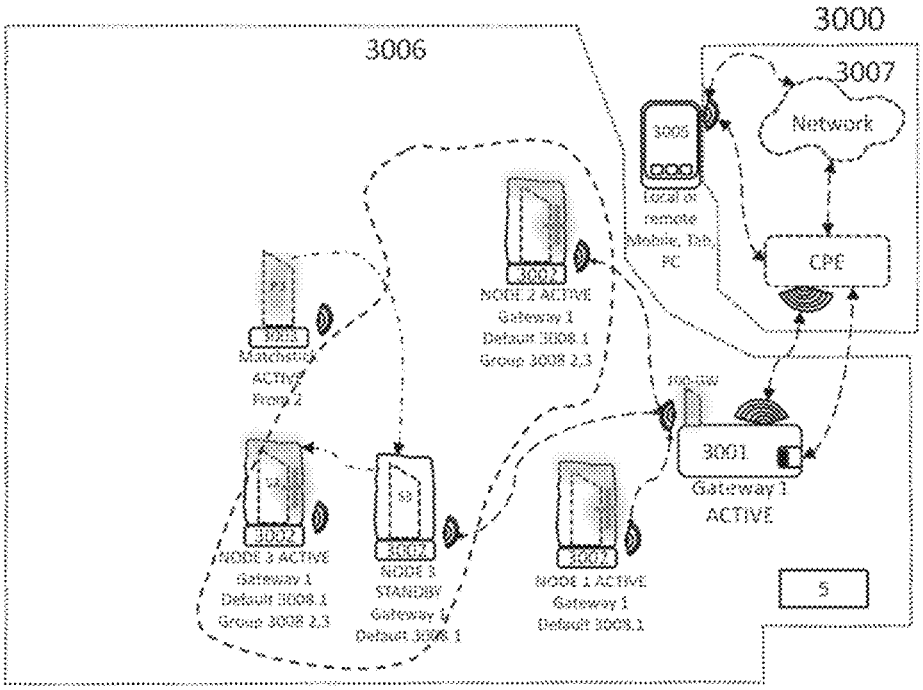
FIG. 15 shows the method (3000) for connecting to the network of objects (3006) of the units and for creating functional groups (3008) within the network of objects (3006). In particular.
Figure 16:
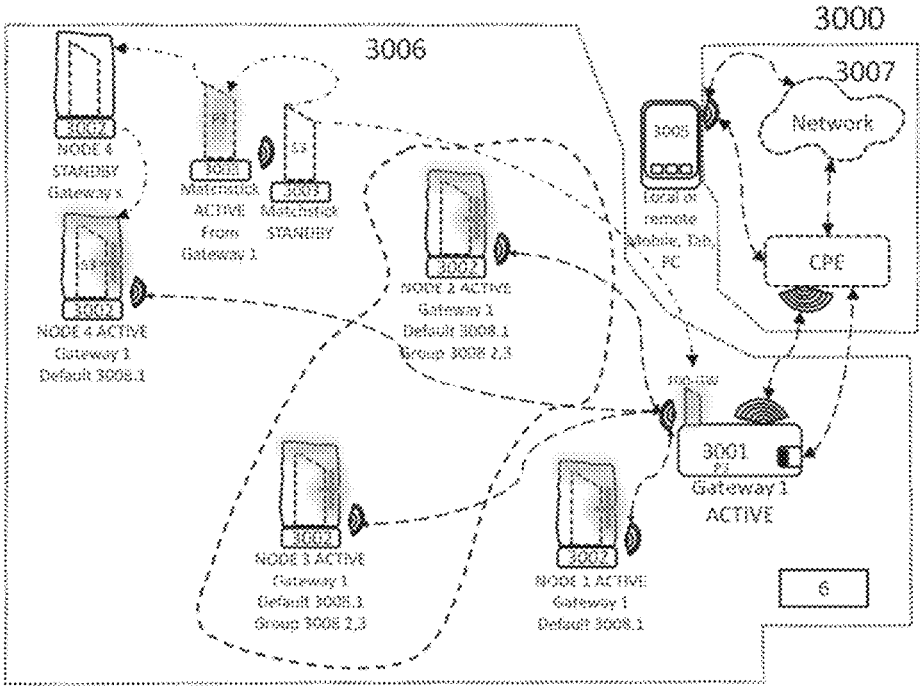
FIG. 16 shows the method (3000) for connecting to the network of objects (3006) of the units and for creating functional groups (3008) within the network of objects (3006). In particular.
Figure 17:
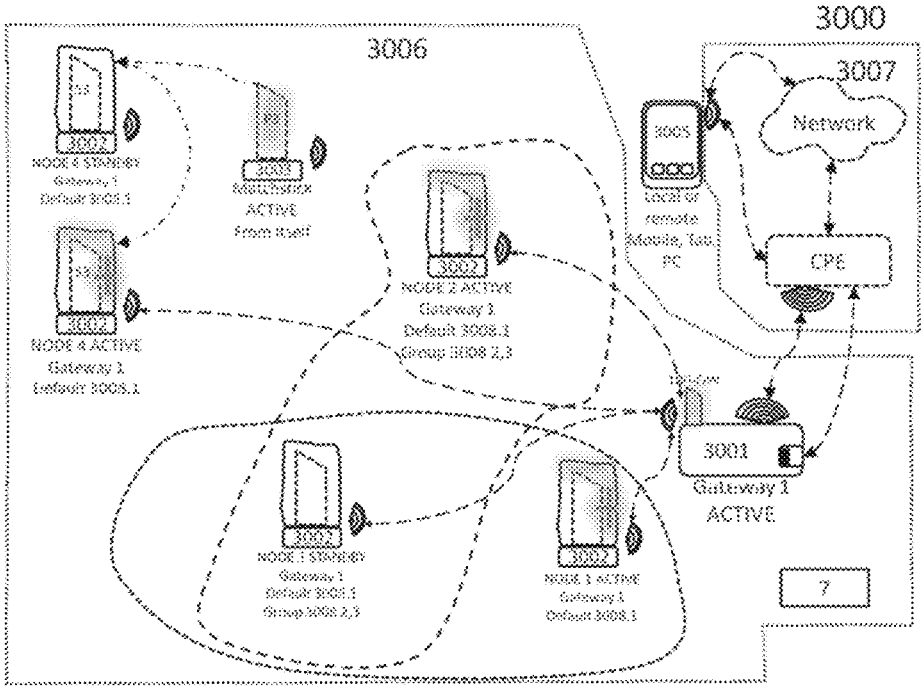
FIG. 17 shows the method (3000) for connecting to the network of objects (3006) of the units and for creating functional groups (3008) within the network of objects (3006). In particular.
Figure 18:
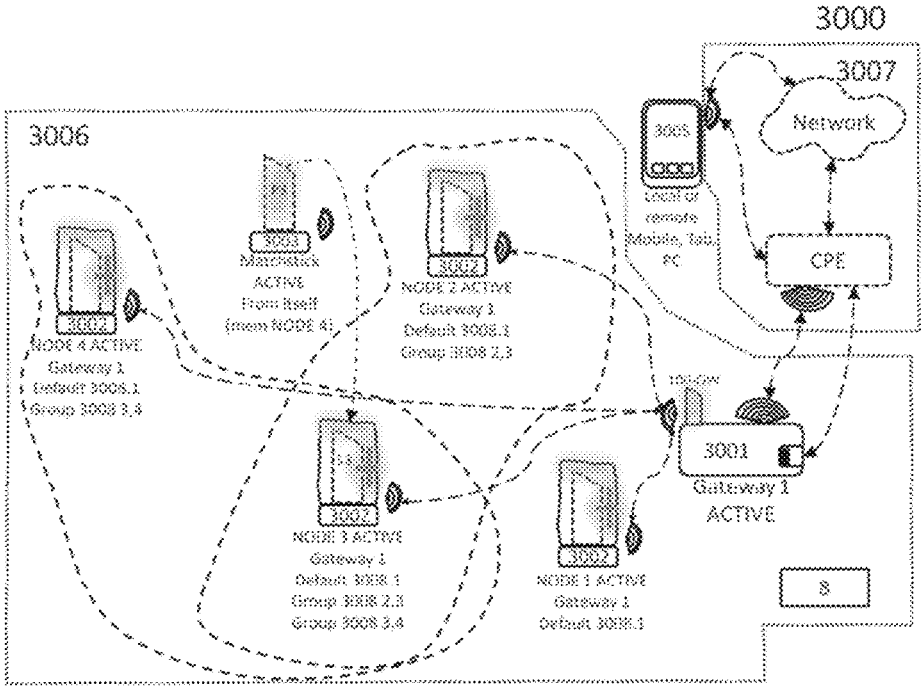
FIG. 18 shows the method (3000) for connecting to the network of objects (3006) of the units and for creating functional groups (3008) within the network of objects (3006). In particular.

FIGS. 14, 15 and 16 show the use of the MATCHSTICK unit, which behaves in all respects as a match. Match MATCHSTICK is lit with NODE 2 (FIG. 14) and it lights NODE 3 (FIG. 15). Since NODE 2 and 3 were already present in network 3006, a functional group 2-3 is created.

In FIG. 16, match MATCHSTICK is lit with GATEWAY, importing from it the ability to add other units to the network, in fact by lighting a NODE 4 not yet present in 3006, match MATCHSTICK adds it to network 3006.

The same match MATCHSTICK (FIGS. 17 and 18), which is lit on its own and not through other units, is used to create a functional group 3-4 by lighting in a sequence NODE 3 and NODE 4 (already present in network 3006).

Figure 19:
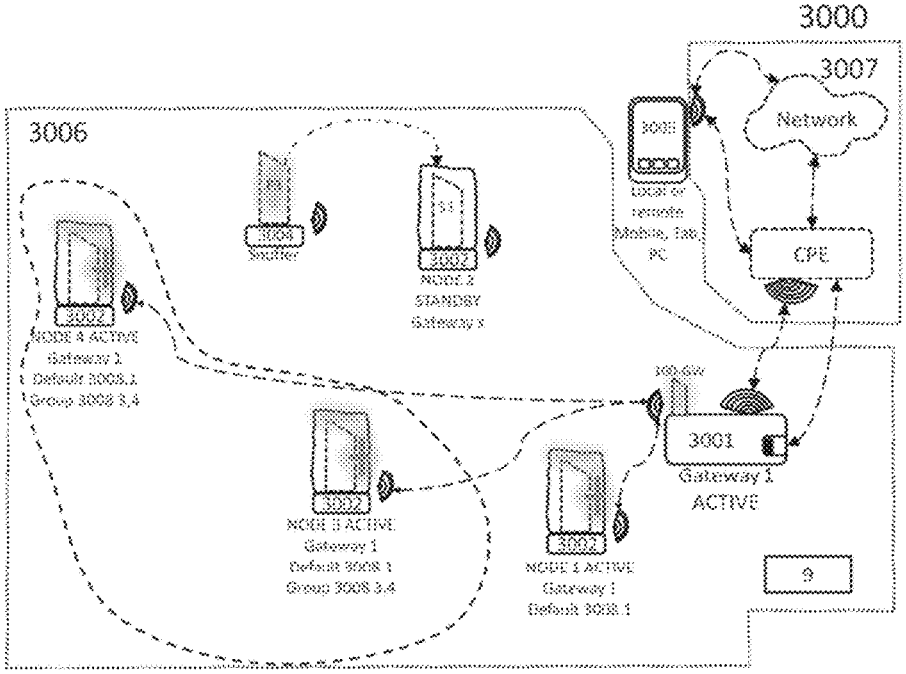
FIG. 19 shows the method (3000) for connecting to the network of objects (3006) of the units and for creating functional groups (3008) within the network of objects (3006). In particular.

Finally, FIG. 19 shows the task of a "SNUFFER" unit. This unit behaves like a candle blower and starting from a unit in "BLOW" state according to method 1000 (which alone would blow any unit), it adds it the ability to erase any property subsequently imported from the unit that it blows. In FIG. 19, a SNUFFER blows NODE 2, removing it from the network and all the groups that contained it.

Figure 20:
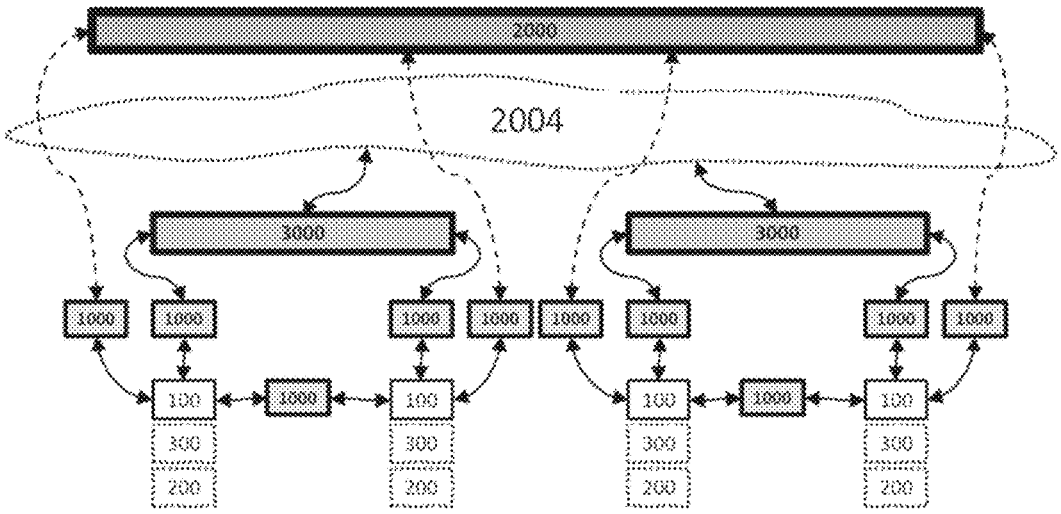
FIG. 20 shows a complete system that includes the optical units 100 (single or combined with units 300 and 200), the method 1000 that allows the direct interaction between optical units 100, the method 1000 that allows together with method 3000 to build local unit networks, the method 1000 that together with method 2000 allows the generation of higher-order services connections over the internet.

FIG. 20 finally shows the relationship between the gesture-ritual control units, the method 1000 used as the basis for method 3000 that is used to create the local network of things 3006 and connect them to the external network 3007, by which server 2004 is accessed, with which, using method 2000, digital service links are created.

Finally, it is clear that additions, changes or variants may be made to the system and lamp object of the present invention which are obvious to a man skilled in the art, without departing from the scope of protection that is provided by the appended claims.

The invention claimed is:

1. A system comprising:

at least two optical units (100) for ritual-gestural control of sending and receiving of commands between devices, said commands including at least device turning on and device turning off, said devices each being provided with one of said at least two optical units (100), each said optical unit (100) comprising:

at least one upper part (100.*b*), the at least one upper part (100.*b*) comprising at least one cover (104) provided with an opening, a coating (102) that limits optical radiation, and an optical guide (101), the optical guide (101) being made of vitreous material or plastic material; and at least one lower part (100.*a*) containing electric, electronic and electromechanical components and circuitry, said electric, electronic and electromechanical components and circuitry comprising:

i) at least one photo-emitter device (105), ii) at least one photo-detector device (107) optimized for detection of an emission spectrum of the at least one photo-emitter device (105), and iii) at least one processing and control unit (110) provided with:

a) a management and control circuitry (110.2), b) at least one connection and control section (110.4) for a power supply source, and c) at least one acquisition, processing and control unit (110.1) configured for managing input and output, storing digital data in volatile and non-volatile form, managing timing, driving the at least one photo-emitter device (105), acquiring a state of the at least one photo-detector device (107), and controlling the management and control circuitry (110.2), wherein at least one of the optical units (100) comprises at least one optical filter (104.*a*) in the opening of the at least one cover (104), the at least one optical filter (104.*a*) adapted to limit an optical spectrum outside the emission spectrum of the at least one photo-emitter device (105), and wherein at least one of the optical units (100) comprises, at a base of the optical guide (101), at least one area (101.*a*) of maximum optical coupling and minimum dispersion.

2. A system comprising:

at least two optical units (100) for ritual-gestural control of sending and receiving of commands between devices, said commands including at least device turning on and device turning off, said devices each being provided with one of said at least two optical units (100), each said optical unit (100) comprising:

at least one upper part (100.*b*), the at least one upper part (100.*b*) comprising at least one cover (104) provided with an opening, a coating (102) that limits optical radiation, and an optical guide (101), the optical guide (101) being made of vitreous material or plastic material; and at least one lower part (100.*a*) containing electric, electronic and electromechanical components and circuitry, said electric, electronic and electromechanical components and circuitry comprising:

i) at least one photo-emitter device (105), ii) at least one photo-detector device (107) optimized for detection of an emission spectrum of the at least one photo-emitter device (105), and iii) at least one processing and control unit (110) provided with:

a) a management and control circuitry (110.2), b) at least one connection and control section (110.4) for a power supply source, and c) at least one acquisition, processing and control unit (110.1) configured for managing input and output, storing digital data in volatile and non-volatile form, managing timing, driving the at least one photo-emitter device (105), acquiring a state of the at least one photo-detector device (107), and controlling the management and control circuitry (110.2), wherein at least one of the optical units (100) comprises at least one optical filter (104.*a*) in the opening of the at least one cover (104), the at least one optical filter (104.*a*) adapted to limit an optical spectrum outside the emission spectrum of the at least one photo-emitter device (105), and wherein at least one of the optical units (100) comprises, at a base of the optical guide (101), at least one dedicated area (101.*b*) of optical coupling and dispersion dedicated to a light source (103).

3. A system comprising:

at least two optical units (100) for ritual-gestural control of sending and receiving of commands between devices, said commands including at least device turning on and device turning off, said devices each being provided with one of said at least two optical units (100), each said optical unit (100) comprising:

at least one upper part (100.*b*), the at least one upper part (100.*b*) comprising at least one cover (104) provided with an opening, a coating (102) that limits optical radiation, and an optical guide (101), the optical guide (101) being made of vitreous material or plastic material; and at least one lower part (100.*a*) containing electric, electronic and electromechanical components and circuitry, said electric, electronic and electromechanical components and circuitry comprising:

i) at least one photo-emitter device (105), ii) at least one photo-detector device (107) optimized for detection of an emission spectrum of the at least one photo-emitter device (105), and iii) at least one processing and control unit (110) provided with:

a) a management and control circuitry (110.2), b) at least one connection and control section (110.4) for a power supply source, and c) at least one acquisition, processing and control unit (110.1) configured for managing input and output, storing digital data in volatile and non-volatile form, managing timing, driving the at least one photo-emitter device (105), acquiring a state of the at least one photo-detector device (107), and controlling the management and control circuitry (110.2), wherein at least one of the optical units (100) comprises, at a base of the optical guide (101), at least one area of maximum reflection (101.*c*) for optical radiation coming from within the optical guide.

4. The system according to claim 2, wherein the management and control circuitry (110.2) controls an intensity of light and color of the light source (103).

5. A system comprising:

at least two optical units (100) for ritual-gestural control of sending and receiving of commands between devices, said commands including at least device turning on and device turning off, said devices each being provided with one of said at least two optical units (100), each said optical unit (100) comprising:

at least one upper part (100.*b*), the at least one upper part (100.*b*) comprising at least one cover (104) provided with an opening, a coating (102) that limits optical radiation, and an optical guide (101), the optical guide (101) being made of vitreous material or plastic material; and at least one lower part (100.*a*) containing electric, electronic and electromechanical components and circuitry, said electric, electronic and electromechanical components and circuitry comprising:

i) at least one photo-emitter device (105), ii) at least one photo-detector device (107) optimized for detection of an emission spectrum of the at least one photo-emitter device (105), and iii) at least one processing and control unit (110) provided with:

a) a management and control circuitry (110.2), b) at least one connection and control section (110.4) for a power supply source, and c) at least one acquisition, processing and control unit (110.1) configured for managing input and output, storing digital data in volatile and non-volatile form, managing timing, driving the at least one photo-emitter device (105), acquiring a state of the at least one photo-detector device (107), and controlling the management and control circuitry (110.2), wherein at least one of the optical units (100) comprises at least one inclinometer (113), wherein the processing and control unit (110.1) is arranged to acquire a state of the at least one inclinometer (113), the acquired state defining an angular interval that the at least two optical units must be within to accept said commands.

6. The system according to claim 1, wherein at least one of the optical units (100) comprises at least one battery (112) as power supply source.

7. The system according to claim 1, wherein at least one of the optical units (100) comprises at least one audio inlet (115) connected by electronic circuitry (110.3) to the at least one processing and control unit (110).

8. The system according to claim 1, wherein at least one of the optical units (100) comprises at least one electronic circuitry for the wireless connection (110.5) of said at least two optical units (100).

9. The system according to claim 8, wherein at least one of the at least two optical units (100) comprises at least one antenna (106) connected to the at least one electronic circuitry for the wireless connection (110.5).

10. The system according to claim 1, wherein at least one of the optical units (100) comprises at least one interconnection section (108) for managing further input and output for the at least one processing and control section (110).

11. The system according to claim 10, further comprising at least one expansion unit (300) comprising at least one processing and control unit (303) provided with at least one connection and control section (305.5), a power supply source, at least one acquisition, processing and control unit (303.1) configured for managing input and output and for storing digital data in volatile and non-volatile form, and an interconnection section (301) for interconnection to the at least one interconnection section (108) of the at least one optical unit (100) comprising the at least one interconnection section (108).

12. The system according to claim 11, wherein the at least one expansion unit (300) comprises at least one electronic circuitry (303.2) for eke wireless connection.

13. The system according to claim 12, comprising at least one antenna (304) connected to the electronic circuitry (303.2) for 4-*re* wireless connection.

14. The system according to claim 11, wherein the at least one expansion unit (300) comprises at least one audio inlet (306) connected by means of suitable circuitry (303.3) to the processing and control unit (303).

15. The system according to claim 11, further comprising at least one candle holder, the at least one candle holder being comprised of the at least one optical unit (100) comprising the at least one interconnection section (108) that connects to the at least one expansion unit (300).

16. The system according to claim 15, wherein the at least one candle holder comprises at least one charging circuitry (205) connectable simultaneously to plural of the at least two optical units for charging each of the optical units via the at least one interconnection section (108).

17. The system according to claim 2, wherein at least one of the optical units (100) comprises at least one battery (112) as a power supply source.

18. The system according to claim 2, wherein at least one of the optical units (100) comprises at least one audio inlet (115) connected by electronic circuitry (110.3) to the at least one processing and control unit (110).

19. The system according to claim 2, wherein at least two of the optical units (100) each comprise an interconnection section (108) for managing further input and output for the at least one processing and control section (110).

20. The system according to claim 19, further comprising:

at least one expansion unit (300) comprising at least one processing and control unit (303) provided with at least one connection and control section (305.5), a power supply source, and at least one acquisition, processing and control unit (303.1) configured for managing input and output and for storing digital data in volatile and non-volatile form, and an interconnection section (301) for interconnection to the interconnection section (108) of the at least two optical units (100) comprising the interconnection section (108), wherein the at least two optical units (100) comprising the interconnection section (108), and wherein the candle holder further comprises at least one charging circuitry (205) connectable via each interconnection section (108) to simultaneously charge each of the at least two optical units.

21. The system according to claim 3, further comprising:

at least one expansion unit (300), a candle holder, wherein at least two of the optical units (100) each comprise an interconnection section (108) for managing further input and output for the at least one processing and control section (110), the at least one expansion unit (300) comprises at least one processing and control unit (303) provided with at least one connection and control section (305.5), a power supply source, and at least one acquisition, processing and control unit (303.1) configured for managing input and output and for storing digital data in volatile and non-volatile form, and an interconnection section (301) for interconnection to the interconnection section (108) of the at least two optical units (100) comprising the interconnection section (108), and wherein the candle holder comprises at least one charging circuitry (205) connectable via each interconnection section (108) to simultaneously charge each of the at least two optical units.

* * * * *